US007811014B2

(12) United States Patent
Tamaki et al.

(10) Patent No.: US 7,811,014 B2
(45) Date of Patent: Oct. 12, 2010

(54) INK-JET RECORDING APPARATUS

(75) Inventors: Shuichi Tamaki, Nagoya (JP); Kenji Samoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 889 days.

(21) Appl. No.: 11/563,368

(22) Filed: Nov. 27, 2006

(65) Prior Publication Data

US 2007/0122220 A1 May 31, 2007

(30) Foreign Application Priority Data

Nov. 28, 2005 (JP) ..... 2005-341818

(51) Int. Cl.
*B41J 11/20* (2006.01)

(52) U.S. Cl. ..... 400/56; 400/59; 347/8

(58) Field of Classification Search ..... 400/59, 400/56; 347/8

See application file for complete search history.

(56) References Cited

U.S. PATENT DOCUMENTS

| | | | | |
|---|---|---|---|---|
| 4,420,269 | A | 12/1983 | Ackermann et al. | |
| 6,168,260 | B1 * | 1/2001 | Yanagi et al. | 347/37 |
| 6,363,573 | B1 * | 4/2002 | Harsh | 15/354 |
| 6,450,710 | B1 * | 9/2002 | Foster et al. | 400/58 |
| 6,497,466 | B1 * | 12/2002 | Writt | 347/8 |
| 6,736,557 | B2 * | 5/2004 | DeVore et al. | 400/59 |

(Continued)

FOREIGN PATENT DOCUMENTS

EP 0945278 A2 9/1999

(Continued)

OTHER PUBLICATIONS

European Search Report (EP Appln. No. 06024630—counterpart of above-captioned U.S. patent application) dated May 3, 2007.

*Primary Examiner*—Ren Yan
*Assistant Examiner*—David Banh
(74) *Attorney, Agent, or Firm*—Baker Botts L.L.P.

(57) ABSTRACT

An image recording apparatus, including a carriage which is reciprocated in a reciprocating direction; a pair of guide frames which extend parallel to each other in the reciprocating direction and which cooperate with each other to guide a reciprocating movement of the carriage, wherein the two guide frames are separate from each other in a conveying direction in which a recording medium is conveyed and which is perpendicular to the reciprocating direction, and wherein the carriage includes a main frame which is supported by the two guide frames such that the main frame bridges the two guide frames, and additionally includes at least two sliding members each of which has a sliding surface which slides on a corresponding one of the two guide frames in the reciprocating direction; an image recording head which is mounted on the main frame of the carriage and which records an image on the recording medium; a driving device which reciprocates the carriage in the reciprocating direction; and a gap adjusting device which changes, by utilizing a portion of the reciprocating movement of the carriage, a distance between the sliding surface of said each of said at least two sliding members and the main frame in a perpendicular direction perpendicular to the reciprocating direction and the conveying direction and thereby adjusts, in the perpendicular direction, a gap between the recording medium and the image recording head mounted on the main frame.

16 Claims, 19 Drawing Sheets

U.S. PATENT DOCUMENTS

| | | | | |
|---|---|---|---|---|
| 7,434,901 | B2 * | 10/2008 | Koh et al. | 347/8 |
| 7,530,750 | B2 * | 5/2009 | Ho | 400/649 |
| 7,585,123 | B2 * | 9/2009 | Ueda et al. | 400/56 |
| 2001/0021330 | A1 | 9/2001 | Kishida et al. | |
| 2003/0146640 | A1 * | 8/2003 | Nakajima | 296/70 |
| 2004/0091297 | A1 * | 5/2004 | Kelley et al. | 400/55 |
| 2004/0246284 | A1 | 12/2004 | Murai et al. | |
| 2005/0152726 | A1 | 7/2005 | Ueda et al. | |
| 2006/0024118 | A1 * | 2/2006 | Niikura et al. | 400/691 |
| 2006/0257185 | A1 * | 11/2006 | Furihata | 400/55 |

FOREIGN PATENT DOCUMENTS

| | | | |
|---|---|---|---|
| EP | 1428672 | A1 | 6/2004 |
| JP | 63041169 | A | 2/1988 |
| JP | 2003341173 | | 3/2003 |
| JP | 2003175654 | | 6/2003 |
| JP | 2003231326 | | 8/2003 |
| JP | 2004322515 | | 11/2004 |

* cited by examiner

INK-JET RECORDING APPARATUS

The present application is based on Japanese Patent Application No. 2005-341818 filed on Nov. 28, 2005, the contents of which are incorporated herein by reference.

BACKGROUND OF THE INVENTION

1. Field of the Invention

The present invention relates to an image recording apparatus such as an inkjet recording apparatus and, in particular, to such an image recording apparatus including (a) a pair of guide frames that are separate from each other in a conveying direction in which a recording medium is conveyed, and that extend parallel to each other in a direction perpendicular to the conveying direction; (b) a carriage including a main frame that is supported by the two guide frames such that the main frame bridges the two guide frames and that is reciprocated on the two guide frames in the direction perpendicular to the conveying direction; and (c) an image recording head such as an inkjet recording head that is mounted on the main frame of the carriage.

2. Discussion of Related Art

There has been known a so-called ink-jet-type image recording device including an ink-jet recording head that ejects droplets of ink toward a recording medium such as a recording sheet and thereby records an image on the recording medium. The recording head is mounted on a carriage that is supported by one or more guide members, and is reciprocated in a direction perpendicular to a conveying direction in which the recording medium is conveyed. While the carriage is reciprocated, the recording head ejects the droplets of ink toward the recording medium. Since the recording head is mounted on the carriage supported by the guide members and the recording medium is supported by a platen, a distance (i.e., a gap) between the recording head and the recording medium is made uniform over an area in which the recording head is reciprocated.

The distance between the recording head and the recording medium influences a degree of definition of the image recorded on the recording medium. In the case where a recording sheet is used as the recording medium, a distance or gap between an ink-ejection surface of the recording head and an image-recording surface of the recording sheet changes depending upon a thickness of the recording sheet. There are known various sorts of recording sheets such as an ordinary sheet, a glossy photo-print sheet, a postcard, or an envelope, and those sheets have different thickness values. If different sorts of recording sheets are used, then the above-indicated gap changes and accordingly a quality of an image recorded on each sort of recording sheet may change, that is, an image having a desired quality may not be recorded. In addition, recently, there has been such a tendency that the size of ink droplets ejected by the recording head is decreased for the purpose of increasing the quality of images and, to this end, the gap between the recording head and the recording medium is decreased. Thus, the recording head may be interfered with by a recording medium having a great thickness. In this technical background, there has been proposed a gap adjusting device that adjusts a gap between a recording head and a recording medium by moving, depending upon a thickness of the recording medium, a recording head in a direction of thickness of the medium. This gap adjusting device is disclosed by, e.g., Patent Document 1 (i.e., Japanese Patent Application Publication No. 2003-231326), Patent Document 2 (i.e., Japanese Patent Application Publication No. 2003-341173), or Patent Document 3 (i.e., Japanese Patent Application Publication No. 2003-175654).

SUMMARY OF THE INVENTION

More specifically explained, Patent Document 1 discloses an image recording device including a carriage including a main frame that is externally fitted on a guide shaft; a movable member that is movable relative to the main frame in a direction of thickness of a recording medium; a recording head that is mounted on the movable member; and a movable-member moving device that moves the movable member in the direction of thickness of the medium. However, since the carriage needs to employ a dual structure including the main frame and the movable member, the size of the carriage is increased and accordingly the structure thereof is complicated. This is also the case with the image recording device disclosed by Patent Document 2.

In addition, Patent Document 3 teaches the art of adjusting the above-indicated gap by rotating the carriage about the guide shaft. Therefore, the recording head may not be made parallel relative to the platen so that the gap may disadvantageously change in the conveying direction in which the recording medium is conveyed. In a particular case where the recording head has a great dimension in the conveying direction, the quality of image recorded on the recording medium may be significantly largely lowered.

In the above-described background, the present invention has been developed. It is therefore an object of the present invention to solve at least one of the above-indicated problems. It is another object of the present invention to provide an image recording apparatus including a gap adjusting device that adjusts a gap between (a) a recording head mounted on a carriage that is supported by a pair of guide frames such that the carriage is reciprocated on the guide frames, and (b) a recording medium, by moving the recording head in a direction of thickness of the recording medium, depending upon the thickness of the medium. It is another object of the present invention to provide an image recording apparatus including a gap adjusting device that adjusts the gap by utilizing a reciprocating movement of the carriage on the guide frames.

According to the present invention, there is provided an image recording apparatus, comprising a carriage which is reciprocated in a reciprocating direction; a pair of guide frames which extend parallel to each other in the reciprocating direction and which cooperate with each other to guide a reciprocating movement of the carriage, wherein the two guide frames are separate from each other in a conveying direction in which a recording medium is conveyed and which is perpendicular to the reciprocating direction, and wherein the carriage includes a main frame which is supported by the two guide frames such that the main frame bridges the two guide frames, and additionally includes at least two sliding members each of which has a sliding surface which slides on a corresponding one of the two guide frames in the reciprocating direction; an image recording head which is mounted on the main frame of the carriage and which records an image on the recording medium; a driving device which reciprocates the carriage in the reciprocating direction; and a gap adjusting device which changes, by utilizing a portion of the reciprocating movement of the carriage, a distance between the sliding surface of said each of said at least two sliding members and the main frame in a perpendicular direction perpendicular to the reciprocating direction and the conveying direction and thereby adjusts, in the perpendicular direction, a gap between the recording medium and the image recording head mounted on the main frame.

In the present recording apparatus, the carriage on which the image recording head is mounted is supported by the two guide frames such that the carriage bridges the two guide frames and is reciprocated in the direction perpendicular to the direction of conveying of the recording medium. While the carriage is reciprocated, the recording head records an image on the recording medium. The main frame carrying the image recording head is supported by the sliding members such that the main frame is movable relative to the guide frames to each of different positions in the perpendicular direction. The main frame is moved relative to each of the guide frames by the gap adjusting device in the perpendicular direction. The gap adjusting device operates for moving the carriage so as to change a distance between the main frame and the sliding surface of each of the sliding members, so that the perpendicular-direction position of the main frame supported by the each sliding member is changed and accordingly the gap between the recording head and the recording medium is adjusted.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention by reference to the drawings.

First Embodiment

Figure 1:
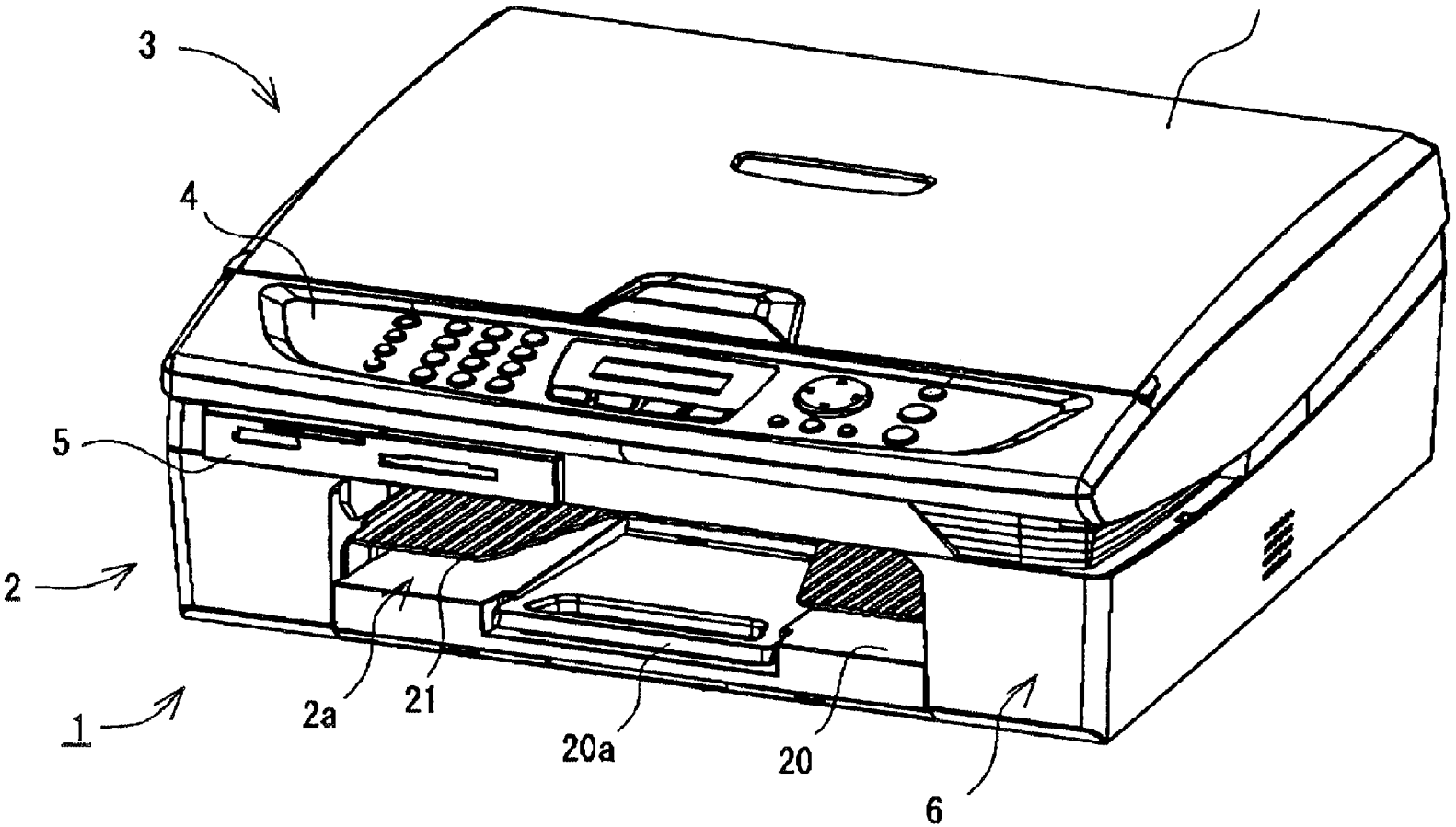
FIG. 1 is a perspective view showing an external construction of a multi-function device (MFD) 1 to which the present invention is applied.
Figure 2:
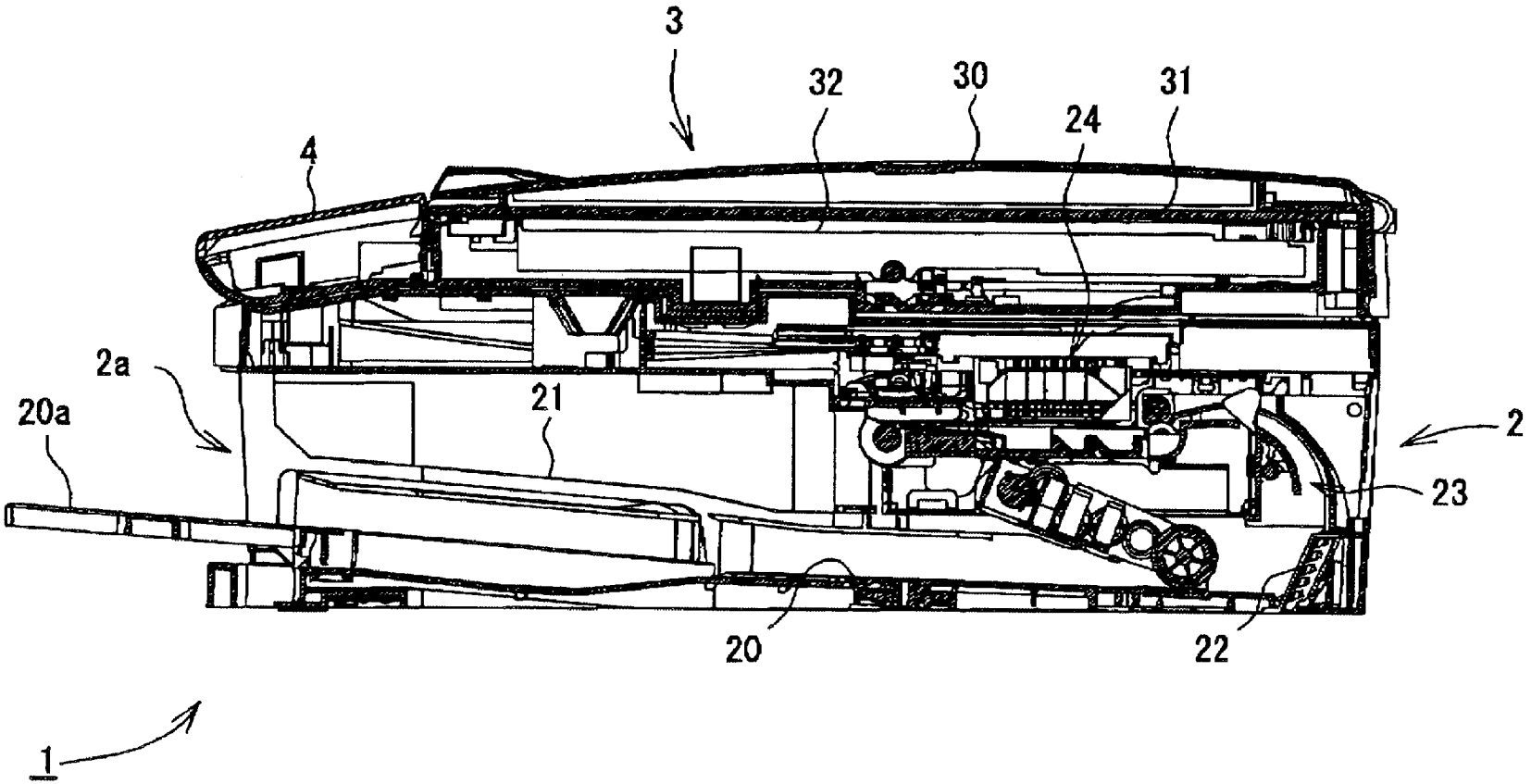
FIG. 2 is a cross-sectional view showing an internal construction of the MFD 1.

FIG. 1 shows an external appearance of a "multi-function device (MFD)" 1 as a first embodiment of the present invention; and FIG. 2 shows an internal construction of the MFD 1. The MFD 1 has a printer function, a scanner function, a copier function, and a facsimile-machine function, and includes a printer portion 2 provided in a lower portion thereof, and a scanner portion 3 provided in an upper portion thereof that is integral with the lower portion. In the present embodiment, the printer portion 2 corresponds to an ink-jet recording apparatus as an image recording apparatus to which the present invention is applied, and accordingly the functions other than the printer function may be omitted. Therefore, the scanner portion 3 may be omitted. Thus, the present invention may be applied to a single-function printer that has only the printer function and does not have the scanner, copier, or facsimile-machine function.

The MFD 1 as the first embodiment of the present invention is of a small size. However, the present invention may be applied to a large-size MFD that includes a plurality of sheet-supply cassettes and an automatic document feeder (ADF). In addition, the MFD 1 may be connected to an external computer (i.e., an external information processor), not shown, so that the MFD 1 may record, based on print data (e.g., image data or document data) supplied from the computer, an image on a recording sheet. Alternatively, the MFD 1 may be connected to an external device such as a digital camera, so that the MFD 1 may record, based on image data supplied from the digital camera, an image on a recording sheet. Moreover, the MFD 1 may include a recording-medium receiving portion that can receive each of various sorts of recording media, such as a memory card, so that the MFD 1 may record, based on image data stored by the each recording medium, an image on a recording sheet.

As shown in FIG. 1, a width and a length of the MFD 1 are greater than a height thereof. Thus, the MFD 1 has a flat appearance with a generally rectangular parallelepiped shape. In the lower portion of the MFD 1, there is provided the printer portion 2. The printer portion 2 has a front opening 2*a* formed in a front surface of the MFD 1, and a sheet-supply tray 20 and a sheet-discharge tray 21 that are exposed through the front opening 2*a* such that the sheet-discharge tray 21 is provided above the sheet-supply tray 20. The sheet-supply tray 20 is for storing recording sheets as a sort of recording media, and can accommodate recording sheets of various sizes not larger than A4 Size, such as A4 Size, B5 Size, or Postcard Size. As shown in FIG. 2, the sheet-supply tray 20 includes a slidable member 20*a* that can be extended, as needed, to increase a bottom surface of the tray 20. In this case, the sheet-supply tray 20 can accommodate Legal-Size recording sheets. As will be described later, the recording sheets accommodated by the sheet-supply tray 20 are supplied, one by one, to an image recording unit 24 of the printer portion 2, so that a desired image is recorded on each recording sheet and then the each recording sheet is discharged onto the sheet-discharge tray 21.

In the upper portion of the MFD 1, there is provided the scanner portion 3, i.e., a so-called "flat-bed" scanner. As shown in FIGS. 1 and 2, the scanner portion 3 includes a cover member 30 as a top plate that can cover an original sheet placed on an upper surface of a platen glass 31. The cover member 30 is pivotable upward and downward so as to be opened and closed. An image sensor 32 is provided below the platen glass 31. The original sheet has an original image to be read by the scanner portion 3. A main scanning direction in which the image sensor 32 is moved to read the original image from the original sheet is a lengthwise direction of the MFD 1.

An operation panel 4 is provided in a front end portion of the upper portion of the MFD 1. The operation panel 4 is for operating the printer portion 2 and the scanner portion 3. The operation panel 4 includes various operation keys and a liquid crystal display (LCD) that are used by a user to input various commands to operate the MFD 1. In the case where the MFD 1 is connected to the external computer, the MFD 1 is operated according to commands supplied from the computer via a printer driver or a scanner driver. The MFD 1 has, in a left, top portion of the front surface thereof (FIG. 1), a slot portion 5 in which each of various sorts of small-size memory cards each as a recording medium can be inserted. When the operation panel 4 is operated by the user in an appropriate manner, the MFD 1 reads image data stored by the each memory card inserted in the slot portion 5, and the LCD of the operation panel 4 displays, based on the thus read image data, information related to the image data. Thus, the user can select, by operating the keys of the operation panel 4, one or more desired images from the image data, so that the printer portion 2 may record the image(s) on the recording sheet(s).

Figure 3:
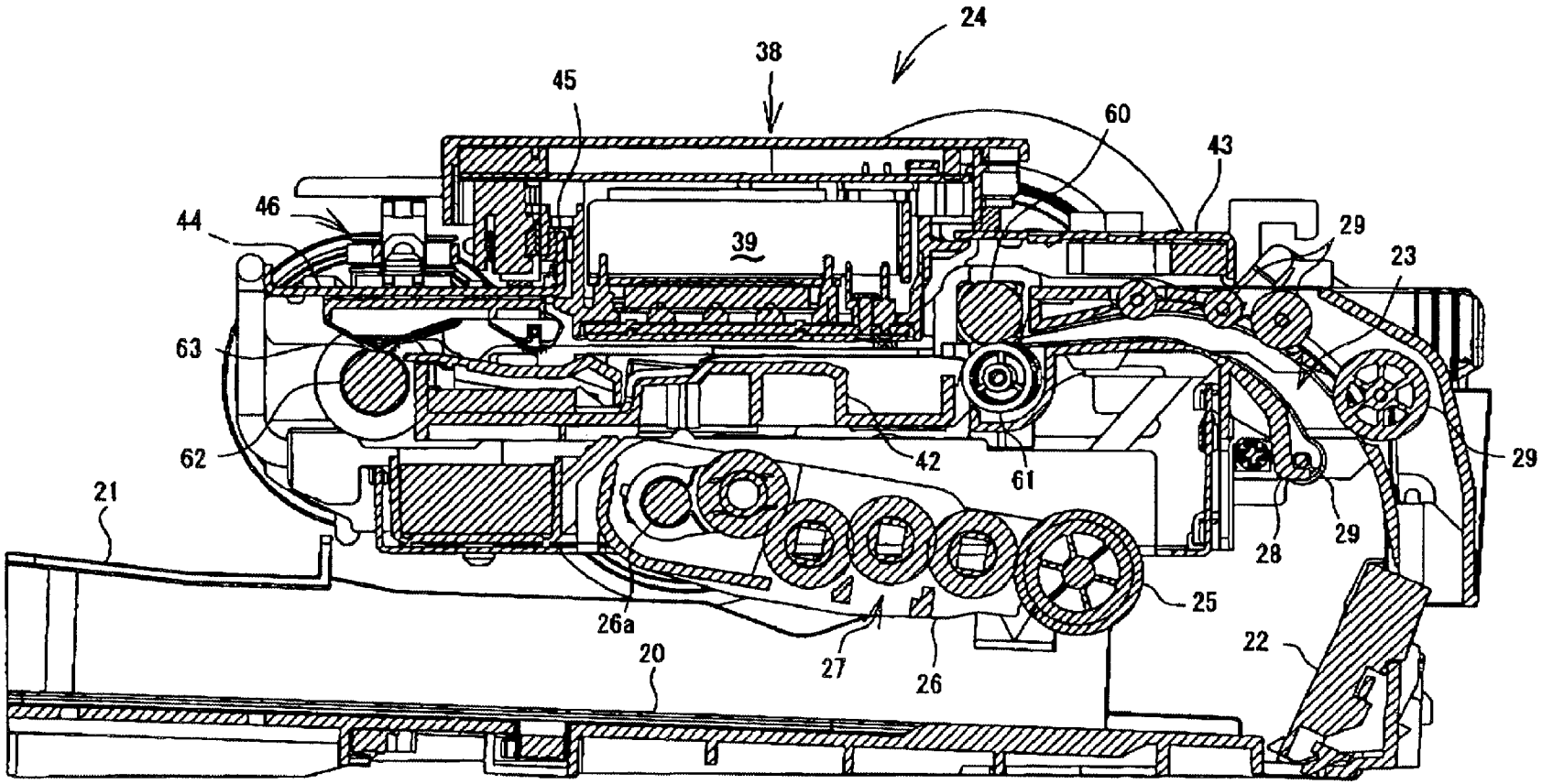
FIG. 3 is an enlarged cross-sectional view showing main elements of a printer portion 2 of the MFD 1.

Hereinafter, the internal construction of the MFD 1, in particular, the construction of the printer portion 2 will be described by reference to FIGS. 2 through 6. As shown in FIGS. 2 and 3, the sheet-supply tray 20, provided in the bottom portion of the MFD 1, has an inclined sheet-separate plate 22 provided in a downstream-side end portion thereof with respect to a sheet-supply direction in which each recording sheet is supplied from the tray 20. The inclined sheet-separate plate 22 is for separating each of the recording sheets stacked in the sheet-supply tray 20, from the other recording sheets, and guiding a movement of the each separated recording sheet in an upward direction toward a sheet-convey path 23. As shown in FIG. 3, the sheet-convey path 23 first extends upward, then curves toward the front side (i.e., left side in the figure) of the MFD 1, and further extends to the front opening 2*a*. That is, the sheet-convey path 23 extends from the rear side of the MFD 1 toward the front side thereof via the image recording unit 24 and the sheet-discharge tray 21. Thus, the sheet-convey path 23 includes a U-turn portion through which the direction of supplying of each recording sheet is changed from the rearward direction to the frontward direction before the each recording sheet is supplied to the image recording unit 24. After the image recording unit 24 records the image on the each recording sheet, the each sheet is discharged onto the sheet-discharge tray 21.

Figure 4:
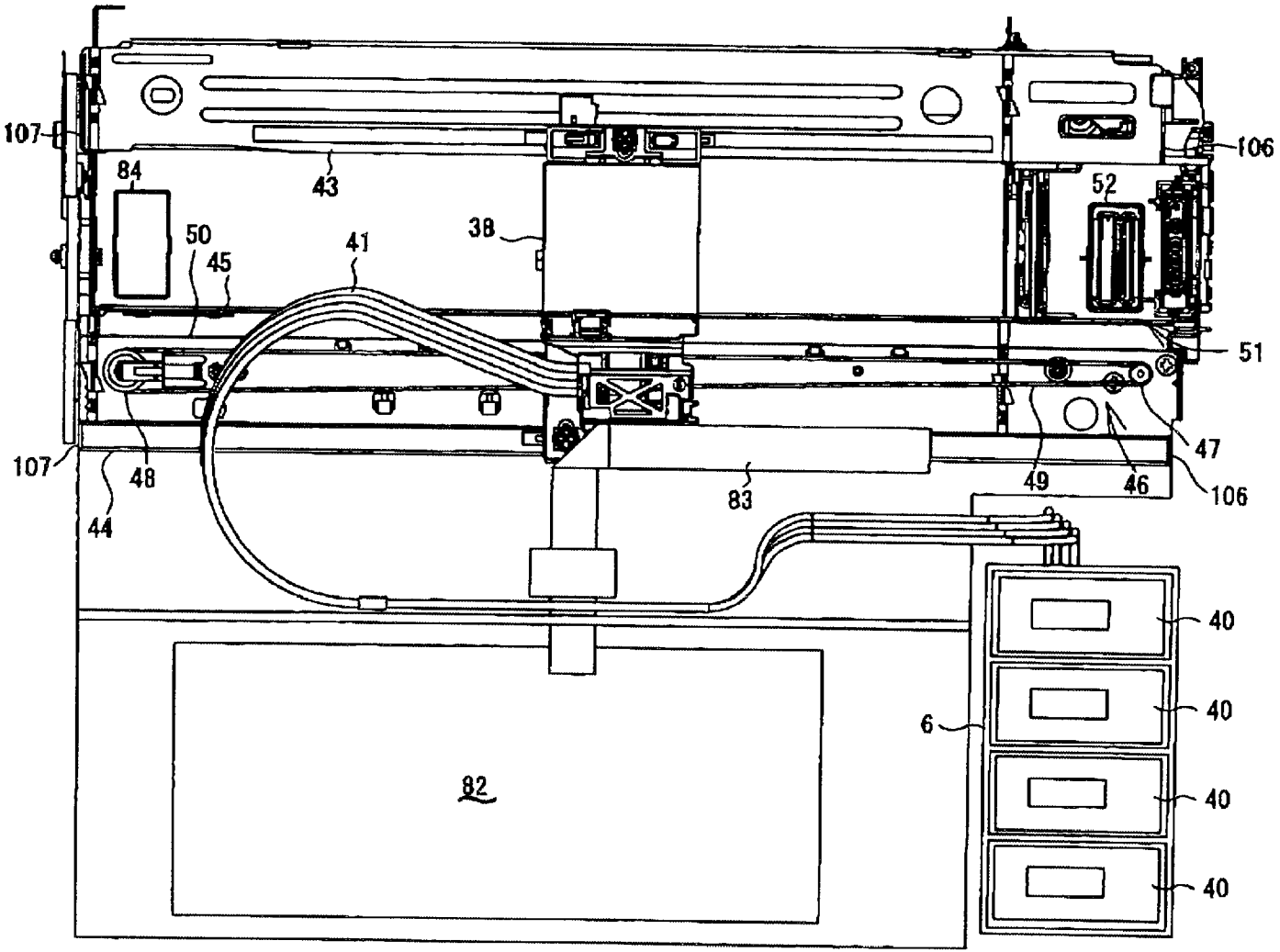
FIG. 4 is an enlarged plan view showing the main elements of the printer portion 2.

FIGS. 3 and 4 show important components of the printer portion 2. As shown in FIG. 3, a sheet-supply roller 25 is provided above the sheet-supply tray 20. The sheet-supply roller 25 cooperates with the inclined sheet-separate plate 22 to separate each of the recording sheets stacked in the sheet-supply tray 20, from the other recording sheets, and supply the thus separated recording sheet to the sheet-convey path 23. The sheet-supply roller 25 is rotatably supported by a lower end portion of a sheet-supply arm 26. In addition, the sheet-supply arm 26 supports a power transmission device 27 that includes a plurality of gears meshed with each other and that is connected, at one end thereof, to the sheet-supply roller 25. When a LF (line feed) motor 71 (FIG. 7) that is connected to the other end of the power transmission device 27 is driven or rotated, a driving power of the LF motor 71 is transmitted to the sheet-supply roller 25 via the transmission device 27, so that the roller 25 is rotated to move each recording sheet toward the inclined sheet-separate plate 22.

An upper or base end portion of the sheet-supply arm 26 is supported by an axis member 26*a*, such that the arm 26 is pivotable downward and upward about the axis member 26*a* so as to be moved toward, and away from, the sheet-supply tray 20. In a state, shown in FIG. 2, in which the sheet-supply tray 20 is set in the MFD 1, a self-weight of the sheet-supply arm 26 or an elastic member (e.g., a spring), not shown, biases the arm 26 downward toward the tray 20; and when the sheet-supply tray 20 is drawn out of the MFD 10, as shown in FIG. 3, the sheet-supply arm 26 is retracted to an upper dead position thereof. When the sheet-supply arm 26 is pivoted downward, the sheet-supply roller 25 supported by the lower end portion of the arm 26 is pressed on the uppermost one of the recording sheets stacked in the sheet-supply tray 20. If, in this state, the sheet-supply roller 25 is rotated, a frictional force is produced between an outer circumferential surface of the roller 25 and an upper surface of the uppermost recording sheet and, owing to this frictional force, the uppermost recording sheet is moved toward the inclined sheet-separate plate 22. When the leading end of the uppermost recording sheet engages the inclined sheet-separate plate 22, the recording sheet is guided upward toward the sheet-convey path 23. When the uppermost recording sheet is moved toward the inclined sheet-separate plate 22, the underlying recording sheet or sheets may be moved with the uppermost recording sheet, because of the friction or static electricity produced therebetween. However, a further movement of the underlying recording sheet or sheets is prevented by the sheet-separate plate 22.

Except for a portion of the sheet-convey path 23 where the image recording unit 24 is provided, the sheet-convey path 23 is defined, and constituted, by an outer guide surface and an inner guide surface that are opposed to each other with an appropriate distance therebetween. In the MFD 1, the outer guide surface is constituted by an inner surface of a casing of the printer portion 11, and the inner guide surface is constituted by a surface of a guide member 28 fixed inside the casing. One or more guide rollers 29 are provided in one or more curved portions of the sheet-convey path 23, as shown in FIG. 3. The guide rollers 29 are freely rotatable about respective axis lines parallel to a widthwise direction of the sheet-convey path 23, i.e., a direction perpendicular to the drawing sheet of FIG. 3, and are attached to the sheet-convey path 23 such that respective outer circumferential surfaces of the rollers 29 are partly exposed in the outer or inner guide surface of the path 23. Owing to the guide rollers 29, each recording sheet can be conveyed smoothly while being continuously contacted with the outer and inner guide surfaces of the sheet-convey path 23, even at the curved portions thereof.

As shown in FIG. 3, the image recording unit 24 is provided midway in the sheet-convey path 23. The image recording unit 24 includes an ink-jet recording head 39 as an image recording head, and a carriage 38 that carries the head 39 and can be moved or reciprocated in a main scanning direction as a reciprocating direction. A construction of the carriage 38 will be described in detail, later. Four ink cartridges 40 (FIG. 4) are provided, in the MFD 1, independent of the ink-jet recording head 39. The four ink cartridges 40 store a cyan ink (C), a magenta ink (M), a yellow ink (Y), and a black ink (Bk), respectively, and supply those inks to the ink-jet recording head 39 via respective ink-supply tubes 41, so that the recording head 39 may eject fine droplets of those inks. While the carriage 38 is reciprocated, the ink-jet recording head 39 ejects the droplets of inks toward each recording sheet being conveyed over a platen 42 opposed to the recording head 39, so that an image is recorded on the each sheet.

As shown in FIG. 4, the MFD 1 has a pair of guide frames 43, 44 that are provided above the sheet-convey path 23. The two guide frames 42, 43 are distant from each other by an appropriate first distance in a sheet-convey direction (i.e., a direction from top to bottom in FIG. 4), and extend in the main scanning direction perpendicular to the sheet-convey direction. The two guide frames 42, 43 are distant from each other by an appropriate second distance in a direction (e.g., a vertical direction) perpendicular to the main scanning direction and the sheet-convey direction. The first distance may be measured between respective centerlines of the two guide frames 43, 44 that are parallel to a lengthwise direction thereof; and the second distance may be measured between respective upper surfaces of the two guide frames 43, 44. The ink-jet recording head 39 is mounted on the carriage 38, and the carriage 38 is supported by the two guide frames 43, 44 such that the carriage 38 bridges the two frames 43, 44 and is slidably reciprocated in the main scanning (i.e., reciprocating) direction perpendicular to the sheet-convey direction. An upstream-side one 43 of the two guide frames 43, 44 that is provided on an upstream side of the carriage 38 with respect to the sheet-convey direction is a plate-like member that is elongate in the widthwise direction of the sheet-convey path 23 and is longer than a reciprocation range in which the carriage 38 is reciprocated. The upper surface of the upstream-side guide frame 43 supports an upstream-side end portion of the carriage 38 such that the carriage 38 is freely slideable on the guide frame 43.

The downstream-side guide frame 44, provided on a downstream side of the carriage 38 with respect to the sheet-convey direction, is also a plate-like member that is elongate in the widthwise direction of the sheet-convey path 23 and is as long as the upstream-side guide frame 43. The downstream-side guide frame 44 includes an edge portion 45 that is bent upward at a substantially right angle relative to a base portion thereof and that supports a downstream-side end portion of the carriage 38. The carnage 38 is supported by the upper surface of the guide frame 44 such that the carriage 38 is freely slideable. The carriage 38 has rollers (not shown) that cooperate with each other to grasp the edge portion 45. Thus, the carriage 38 is mounted on the two guide frames 43, 44 such that the carriage 38 is freely slideable relative to the same 43, 44 and such that the carriage 38 can be reciprocated in the main scanning direction perpendicular to the sheet-convey direction along the edge portion 45 as a reference path. Low-friction members, not shown, may be provided, as needed, on respective portions of the carriage 38 that are adapted to contact the respective upper surfaces of the two guide frames 43, 44.

A carriage driving device 46 is provided on the downstream-side guide frame 44. The carriage driving device 46 includes an endless, annular timing belt 49 that has cogs on an inner surface thereof and is connected, at a portion thereof, to the carriage 38. The timing belt 49 is wound on a drive pulley 47 and a driven pulley 48 that are provided near widthwise opposite ends of the sheet-convey path 23, respectively. An axis member of the drive pulley 47 is supplied with a driving power from a CR (carriage) motor 73 (FIG. 7), so that the drive pulley 47 is rotated and the timing belt 49 is circulated. The endless timing belt 49 may be replaced with a timing belt having opposite ends that are connected to the carriage 38.

Since the timing belt 49 is fixed to the carriage 38, when the timing belt 49 is driven or circulated, the carriage 38 is reciprocated on the two guide frames 43, 44 along the edge portion 45 of the downstream-side guide frame 44. Since the ink-jet recording head 39 is mounted on the carriage 38, the head 39 can be reciprocated in the main scanning direction, i.e., the widthwise direction of the sheet-convey path 23. An encoder strip 50 of a linear encoder 77 (FIG. 7) is provided along the edge portion 45. The linear encoder 77 additionally includes a photo interrupter (not shown) that detects each slit of the encoder strip 50. Based on a detection signal outputted by the linear encoder 77, the reciprocating movement of the carriage 38 is controlled by a control device 64, described later.

As shown in FIG. 3, the platen 42 is provided below the sheet-convey path 23 such that the plate 42 is opposed to the ink-jet recording head 39. The platen 42 extends over an intermediate portion of the reciprocation range of the carriage 38 where each recording sheet is conveyed. A length of the platen 42 is sufficiently larger than a width of a recording sheet of a maximum size that can be used with the MFD 1. Therefore, the widthwise opposite ends of each recording sheet can pass over the platen 42.

As shown in FIG. 4, maintenance units, i.e., a purging device 51 and a waste-ink tray 84 are provided on either side of an image recording area in which the ink-jet recording head 39 can record images on recording sheets, that is, in respective outside areas where each recording sheet does not pass. The purging device 51 is for removing, by suction, air bubbles and/or foreign matters from nozzles 53 (FIG. 5) of the ink-jet recording head 39, and includes a cap member 52 that can cover the nozzles 53 of the recording head 39; a suction pump, not shown, that is connectable to the recording head 39 via the cap member 52; and a moving device, not shown, that moves the cap member 52 toward, and away from, the nozzles 53 of the recording head 39. When the purging device 51 removes, by suction, the air bubbles or the like from the ink-jet recording head 39, first, the carriage 38 is so moved that the recording head 39 is positioned at a position right above the cap member 52 and, in this state, the cap member 52 is moved upward so as to cover fluid-tightly the nozzles 53 opening in the lower surface of the recording head 39. Then, the suction pump connected to the cap member 52 is operated, and the inks are sucked from the nozzles 53 of the recording head 39.

The waste-ink tray 84 is for receiving waste inks when the inkjet recording head 39 carries out an idling operation called a "flushing" operation. When the flushing operation is carried out, the recording head 39 (or the carriage 38) is moved to a left-hand end portion (FIG. 4) of the reciprocation range of the carriage 38, so that the recording head 39 ejects droplets of inks toward the waste-ink tray 84. The waste-ink tray 84 is formed integrally with the platen 42. Thus, the maintenance units 51, 84 cooperate with each other to remove the air bubbles and/or the mixed inks from the ink-jet recording head 39.

As shown in FIGS. 1 and 4, the four ink cartridges 40 are detachably attached to respective cartridge accommodating portions 6 of a casing provided in a front and left portion (i.e., a right portion in FIG. 4) of the printer portion 2. As shown in FIG. 4, in the MFD 1, the cartridge accommodating portions 6 are provided separate from the carriage 38 on which the ink-jet recording head 39 is mounted, and the inks are supplied from the ink cartridges 40 attached to the respective cartridge accommodating portions 6, to the recording head 39 via the respective ink-supply tubes 41.

The four ink cartridges 40 attached to the respective cartridge accommodating portions 6 supply the respective inks to the ink-jet recording head 39 via the respective ink-supply tubes 41 that are independent of each other. Each of the ink-supply tubes 41 is formed of a synthetic resin, and has a flexibility assuring that when the carriage 38 is reciprocated, the each tube 41 is sufficiently largely flexed.

The four ink-supply tubes 41 are drawn out of the respective cartridge accommodating portions 6 to a widthwise middle area of the MFD 1 where respective intermediate portions of the tubes 41 are fixed to an appropriate member such as a frame structure of the MFD 1. However, respective free portions of the ink-supply tubes 41 that are located between the middle area and the carriage 38 are not fixed to any members and accordingly can follow the reciprocating movement of the carriage 38 while changing their shapes. More specifically described, when the carriage 38 is moved toward the right-hand end of the reciprocation range, the ink-supply tubes 41 are flexed such that a radius of curvature of the free portions thereof decreases; and when the carriage 38 is moved toward the left-hand end of the reciprocation range, the ink-supply tubes 41 are flexed such that the radius of curvature of the free portions increases.

Figure 5:
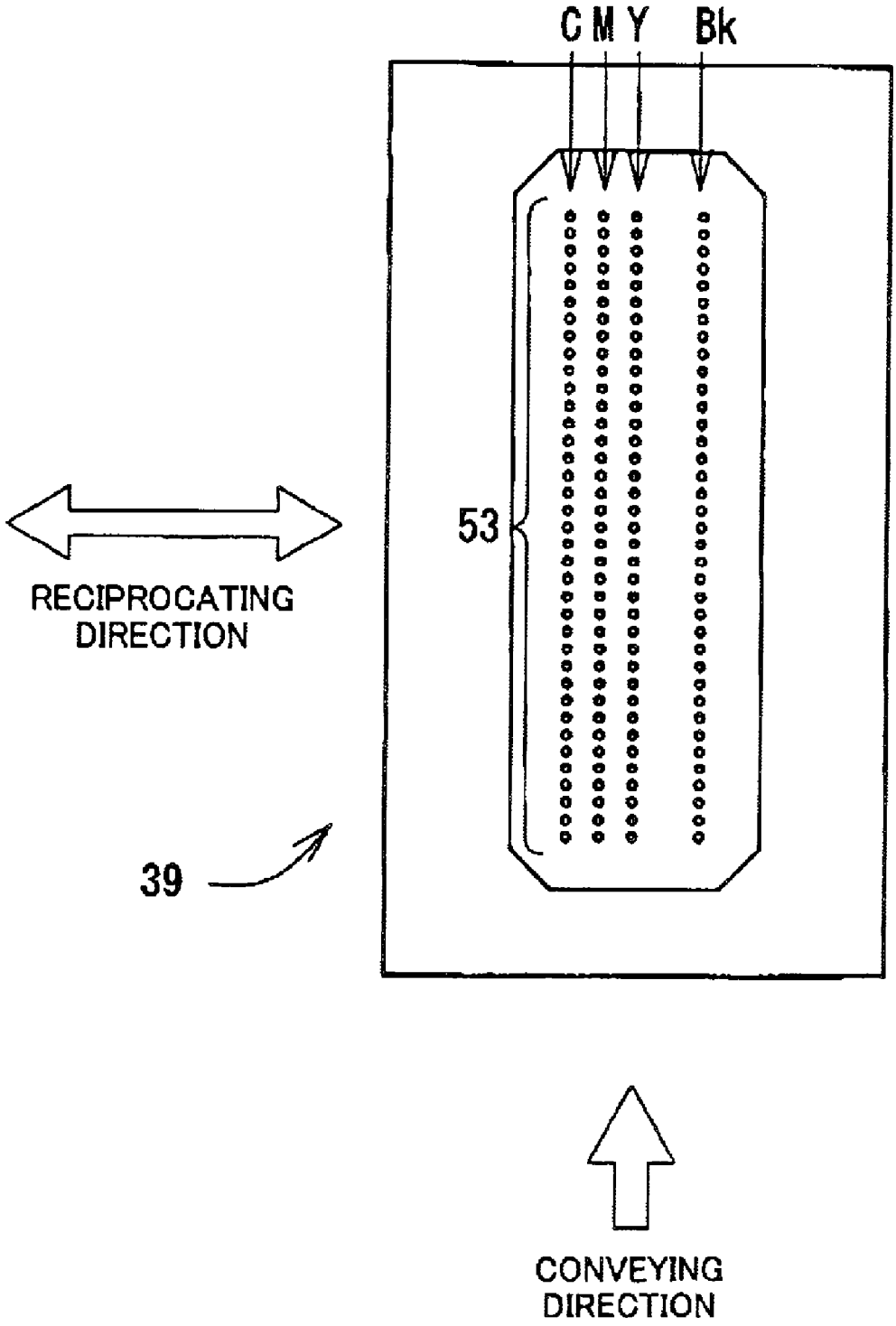
FIG. 5 is a bottom view of an ink-jet recording head 39 of the printer portion 2.

FIG. 5 shows the lower surface of the ink-jet recording head 39 where four groups of nozzles 53 respectively corresponding to the four inks, CMYBk, are arranged in respective arrays in the sheet-convey direction. Thus, four arrays of nozzles 53 are arranged in the main scanning direction in which the carriage 38 is reciprocated. In each array, the nozzles 53 are provided at an appropriate pitch. However, the pitch of provision of the nozzles 53 in each array and/or the total number of the nozzles 53 provided in the each array may be changed, as needed, depending upon, e.g., a resolution of images recorded by the image recording unit 24. In addition, the total number of the arrays of the nozzles 53 may be changed depending upon the total number of the inks used in the MFD 1.

The four inks CMYBk supplied from the four ink cartridges 40 to the ink-jet recording head 39 via the four ink-supply tubes 41 flow to the respective nozzles 53 through respective ink-flow channels including respective ink-supply ports 58, respective buffer tanks 57, respective manifolds 56, and respective cavities 55. When an arbitrary one of piezoelectric elements 54 is deformed, a corresponding one of the nozzles 53 ejects a droplet of ink toward the recording sheet. Air bubbles accumulated in the buffer tanks 57 are removed, by suction, by an air pump, not shown, via respective air-discharge ports 59.

Figure 7:
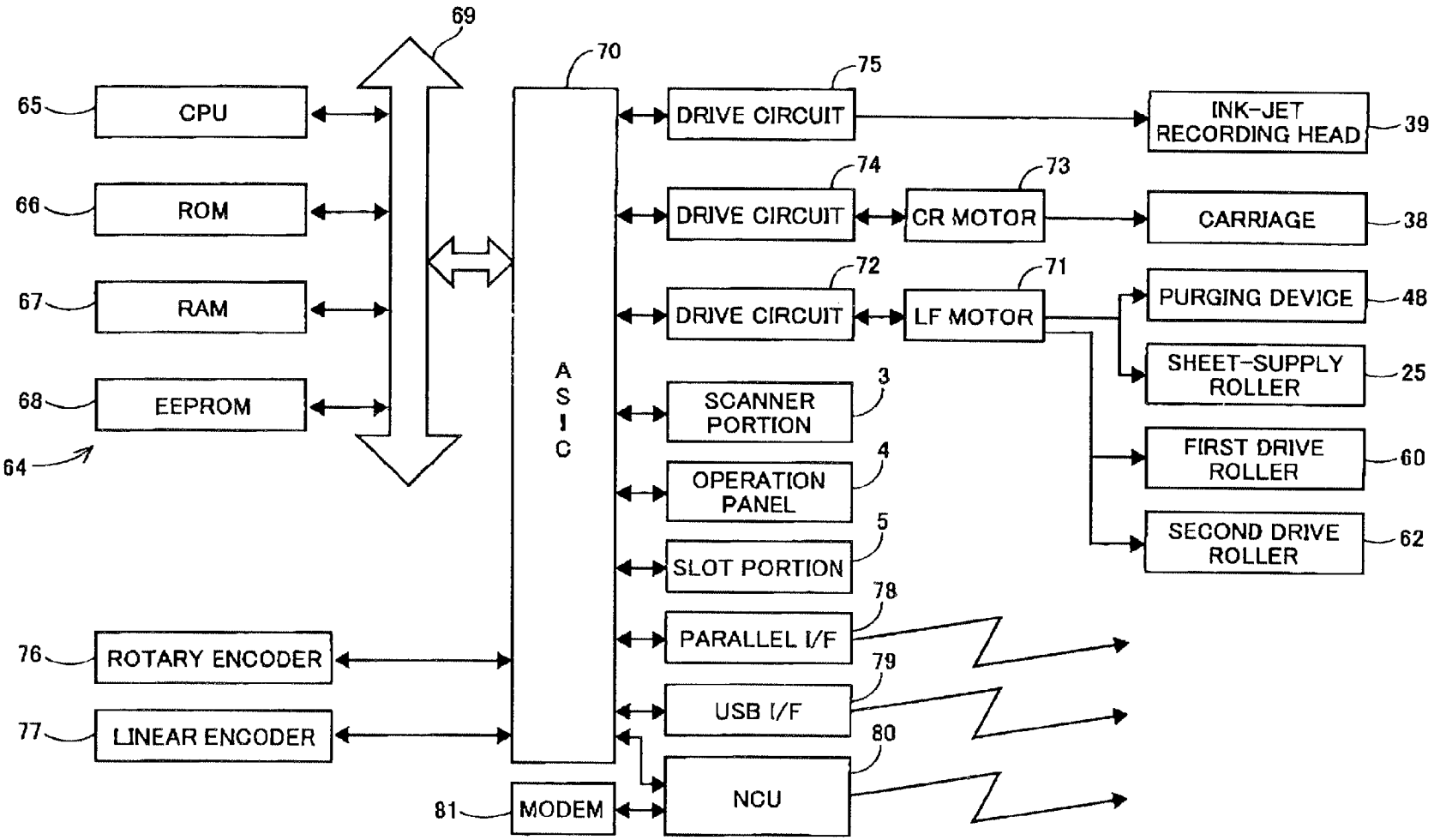
FIG. 7 is a diagrammatic view showing an electric arrangement of a control device 64 of the MFD 1.

As shown in FIG. 3, a drive roller 60 and a presser roller 61 that cooperate with each other to nip each recording sheet conveyed along the sheet-convey path 23 and convey the each sheet onto the platen 42, are provided on the upstream side of the image recording unit 24 with respect to the path 23. In addition, another drive roller 62 and a spur roller 63 that cooperate with each other to nip each recording sheet on which an image has been recorded, and convey the each sheet toward the sheet-discharge tray 21, are provided on the downstream side of the image recording unit 24 in the sheet-convey path 23. The two drive rollers 60, 62 are driven or rotated by the LF motor 71, and the recording sheet, nipped by the first drive roller 60 and the presser roller 61, is intermittently conveyed, on the platen 42, in incremental amounts each corresponding to one image line recorded on the sheet. The respective rotations of the two drive rollers 60, 62 are synchronized with each other and, to this end, the first drive roller 60 is provided with a rotary encoder 76 (FIG. 7). The rotary encoder 76 includes an encoder disc fixed to an axis member of the first drive roller 60, and a photo interrupter that detects slits of the encoder disc and produces pulse signals corresponding to the detected slits. Thus, the respective rotations of the two drive rollers 60, 62 are controlled by the control device 64, based on the thus produced pulse signals.

The presser roller 61 is freely rotatable and is elastically biased against the first drive roller 60 so as to press, with an appropriate pressing force, the same 60. Therefore, when the first drive roller 60 and the presser roller 61 cooperate with each other to nip the recording sheet, the presser roller 56 is elastically retracted by an amount corresponding to the thickness of the recording sheet. Thus, the rotating force of the first drive roller 60 is reliably transmitted to the recording sheet. This is true with the spur roller 63. In the present embodiment, however, the spur roller 63 presses the recording sheet on which the image has been recorded. Therefore, in order to prevent the deterioration of the image recorded on the recording sheet, the spur roller 63 has, like a spur gear, a plurality of projections along an outer circumferential surface thereof.

FIG. 7 diagrammatically illustrates an electric arrangement of the control device 64 of the MFD 1. The control device 64 is for controlling the MFD 1 as a whole including not only the printer portion 3 but also the scanner portion 2. However, since the scanner portion 2 is not an essential feature for the present invention, no detailed description is provided in relation with the manner of controlling of the scanner portion 2. The control device 64 is essentially constituted by a microcomputer including a CPU (central processing unit) 65, a ROM (read only memory) 66, a RAM (random access memory) 67, and an EEPROM (electrically erasable and programmable ROM) 68, and is connected to an ASIC (application specific integrated circuit) 70 via a bus 69.

The ROM 66 stores various control programs used to control various operations of the MFD 1. The RAM 67 is used as a storing area or a working area for temporarily storing various data used by the CPU 65 according to any of the control programs. The EEPROM 68 stores default values and/or flags that need to be kept after the supplying of electric power to the MFD 1 is stopped.

The ASIC 70 outputs, according to a command supplied from the CPU 65, a drive signal to drive the LF motor 71, and supplies the signal to a drive circuit 72 associated with the LF motor 71, so that the drive circuit 72 supplies an electric voltage to the LF motor 71. Thus, the rotation of the LF motor 71 is controlled by the CPU 65.

The drive circuit 72 is for driving the LF motor 71 that is connected to the sheet-supply roller 25, the first drive roller 60, the second drive roller 62, and the purging device 51, and produces, according to the drive signal supplied from the ASIC 70, the electric voltage to drive or rotate the LF motor 71. In response to the electric voltage, the LF motor 71 rotates, and the rotation of the motor 71 is transmitted via respective known power transmission devices each including gears and/or shaft to the sheet-supply roller 25, the first drive roller 60, the second drive roller 62, and the purging device 51.

In addition, the ASIC 70 outputs, according to a command supplied from the CPU 65, a drive signal to drive the CR motor 73, and supplies the signal to a drive circuit 74 associated with the CR motor 73, so that the drive circuit 74 supplies an electric voltage to the CR motor 73. Thus, the rotation of the CR motor 73 is controlled by the CPU 65.

The drive circuit 74 is for driving the CR motor 73 that is connected to the carriage 38, and produces, according to the drive signal supplied from the ASIC 70, the electric voltage to drive or rotate the CR motor 73. In response to the drive signal, the CR motor 73 rotates, and the rotation of the motor 73 is transmitted via the belt driving device 46 to the carriage 38, so that the carriage 38 is reciprocated. Thus, the reciprocation of the carriage 38 is controlled by the CPU 65.

A drive circuit 75 is for driving the ink-jet recording head 39 to eject, at appropriate timings, droplets of the inks toward the recording sheet. The ASIC 70 outputs signals according to a driving control procedure supplied from the CPU 65 and, in response to the output signals from the ASIC 70, the driving circuit 75 drives the recording head 39.

The ASIC 70 is connected to the rotary encoder 76 that detects the rotation amount of the first drive roller 60, and to the linear encoder 77 that detects the movement amount of the carriage 38. In addition the ASIC 70 is connected to the scanner portion 3, the operation panel 4 manually operable by the user to input various operation commands, the slot portion 5 in which each of various sorts of small-size memory cards can be inserted, and a parallel interface 78 and a USB interface 79 each of which communicates data with an external device such as a personal computer (PC) via a parallel cable or a USB cable. In addition, the ASIC 70 is connected to a network control unit (NCU) 80 and a modem 81 that cooperate with each other to provide the MFD 1 with the facsimile-machine function.

As shown in FIG. 4, the control device 64 is constituted by a main substrate 82 that supplies, e.g., recording signals to the ink-jet recording head 39 via a flat cable 83. The flat cable 83 is a belt-like member including conductors that transmit respective electric signals; and a synthetic-resin film such as a polyester film that covers the conductors and thereby electrically insulates the same, and electrically connects between the main substrate 82 and a control substrate (not shown) of the ink-jet recording head 39. The flat cable 83 is first led out of the carriage 38 in the reciprocating direction, and then is curved like a bottom portion of the letter of "U" in a vertical direction. The curved portion of the flat cable 83 is not fixed to any other members, and accordingly the shape of the curved portion changes when the cable 83 follows the reciprocating movement of the carriage 38.

Figure 8:
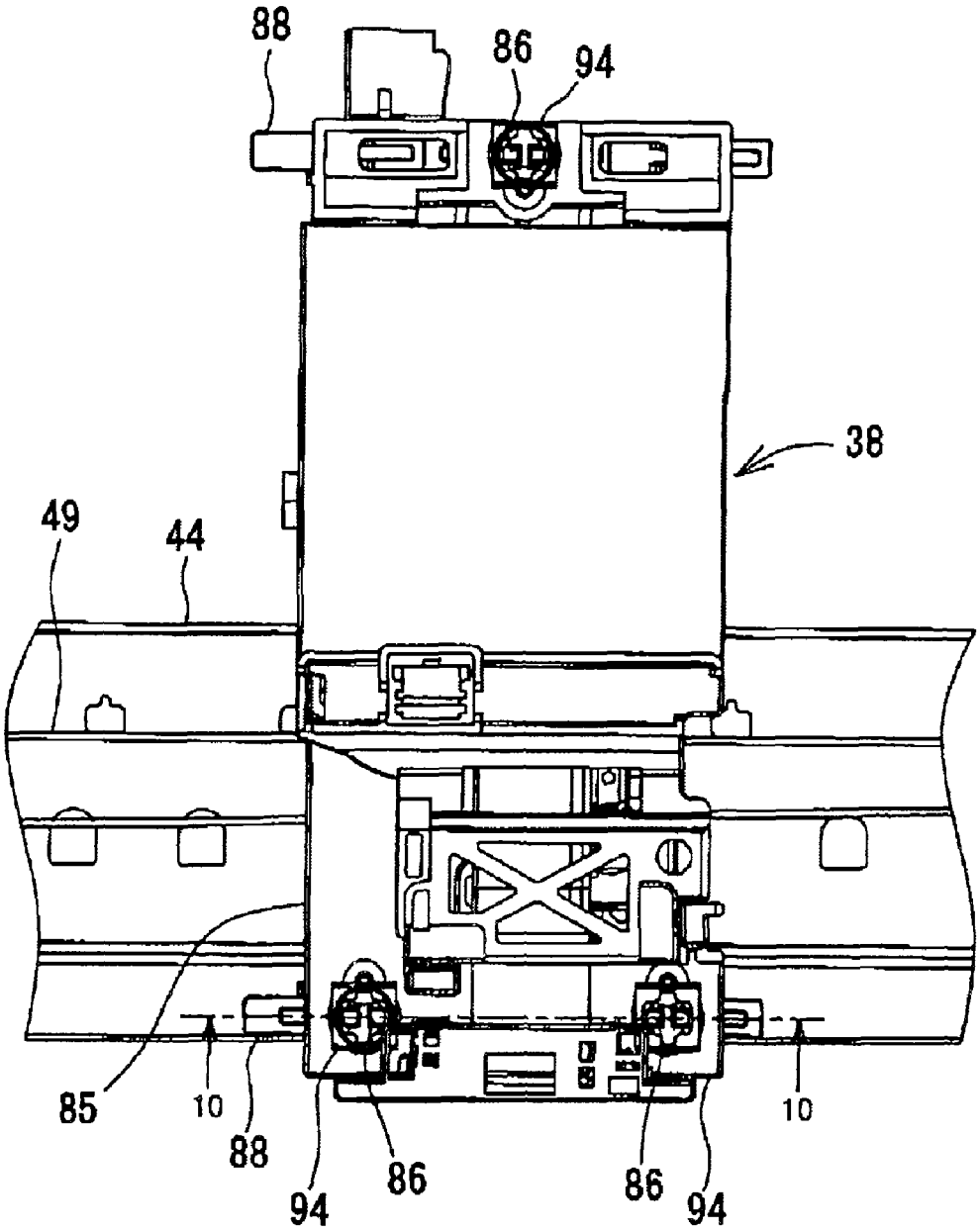
FIG. 8 is an enlarged plan view showing an external construction of a carriage 38 of the printer portion 2.

Hereinafter, the construction of the carriage 38 will be described by reference to FIGS. 8 through 15. In FIG. 8, the guide frame 43 is not shown; and in FIGS. 9 through 15, the two guide frames 43, 44 are not shown.

Figure 9:
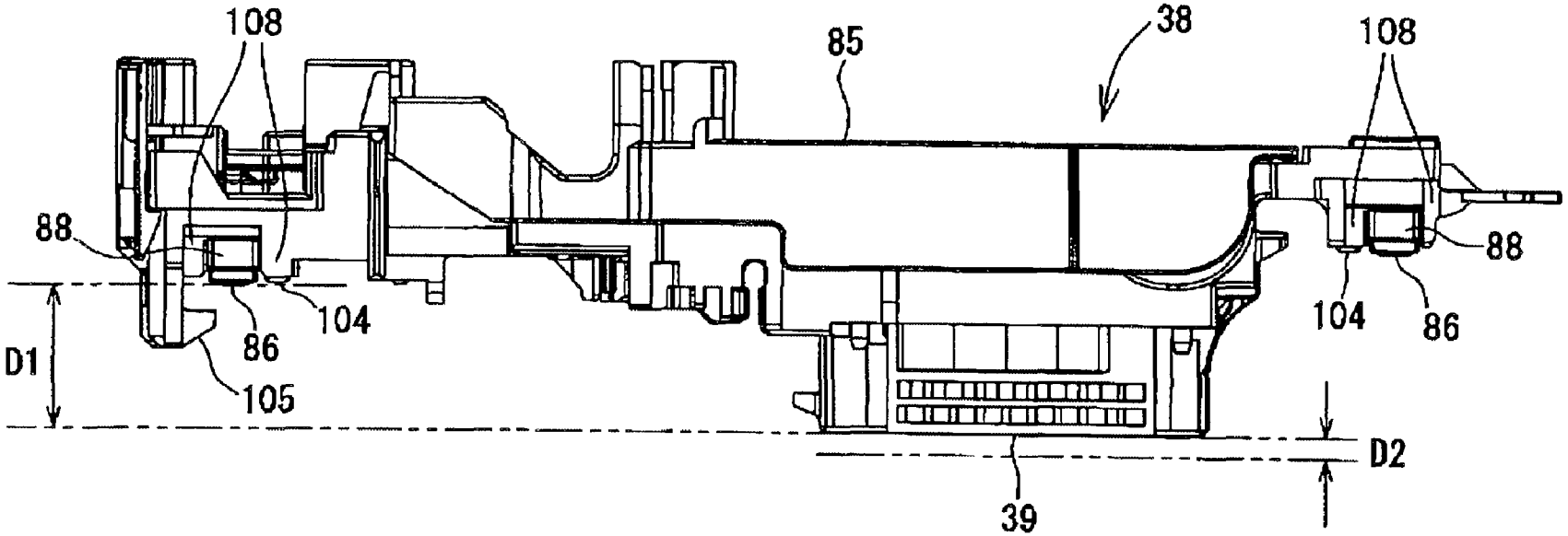
FIG. 9 is a side elevation view of the carriage 38.
Figure 10:
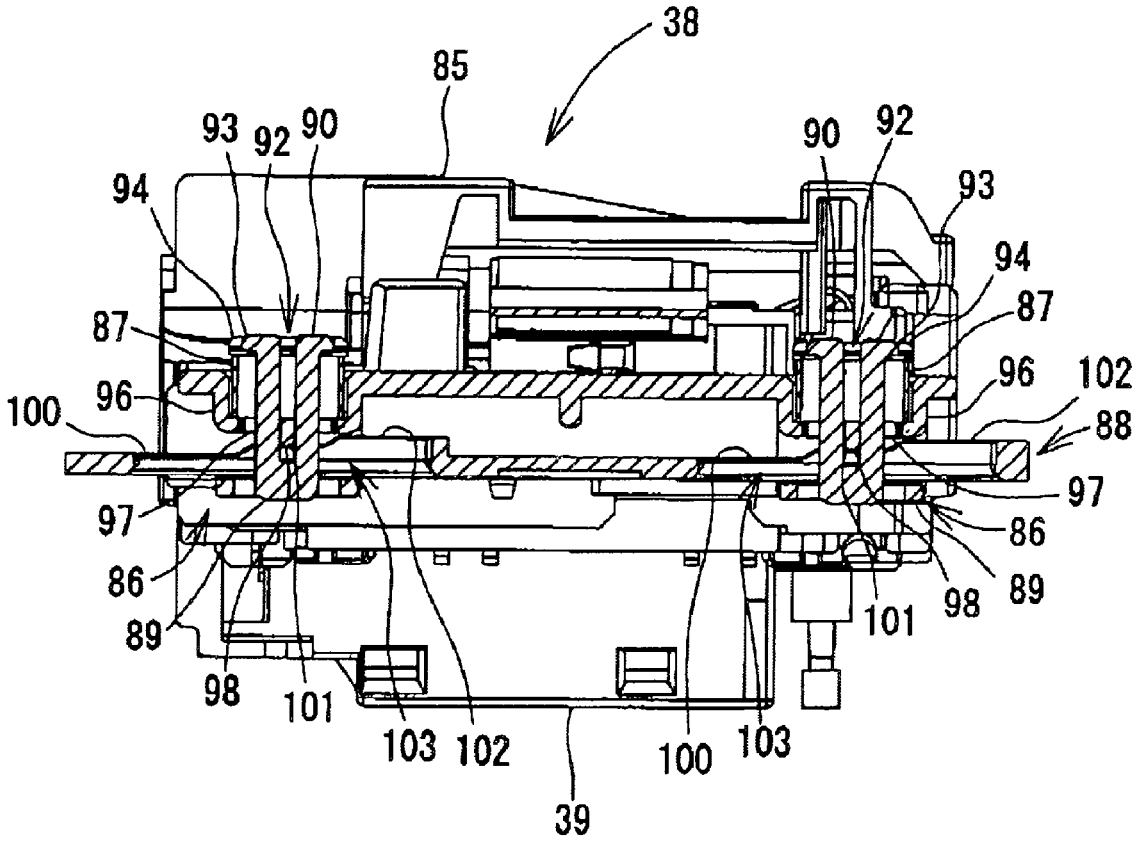
FIG. 10 is a cross-sectional view of the carriage 38, taken along 10, 10 in FIG. 8.

As shown in FIGS. 8, 9, and 10, the carriage 38 includes a main frame 85 on which the ink-jet recording head 39 is mounted; three sliding members 86 that slide on the two guide frames 43, 44 and cooperate with each other to support the main frame 85 at each of different height positions; three compression coil springs 87 as biasing members that cooperate with each other to bias the main frame 85 downward toward the guide frames 43, 44; and two elongate gap-adjusting members 88 that are provided between the main frame 85 and the guide frames 43, 44. One sliding member 86, one compression coil spring 87, and one gap-adjusting member 88 are provided corresponding to the upstream-side guide frame 43 with respect to the sheet-convey direction; and two sliding members 86, two compression coil springs 87, and one gap-adjusting member 88 are provided corresponding to the downstream-side guide frame 44. Since, however, the three sliding members 86 have an identical construction, the three compression coil springs 87 have an identical construction, and the two gap-adjusting members 88 have an identical construction, the following description relates to only the two sliding members 86, the two compression coil springs 87, and the one gap-adjusting member 88 corresponding to the downstream-side guide frame 44.

Figure 11:
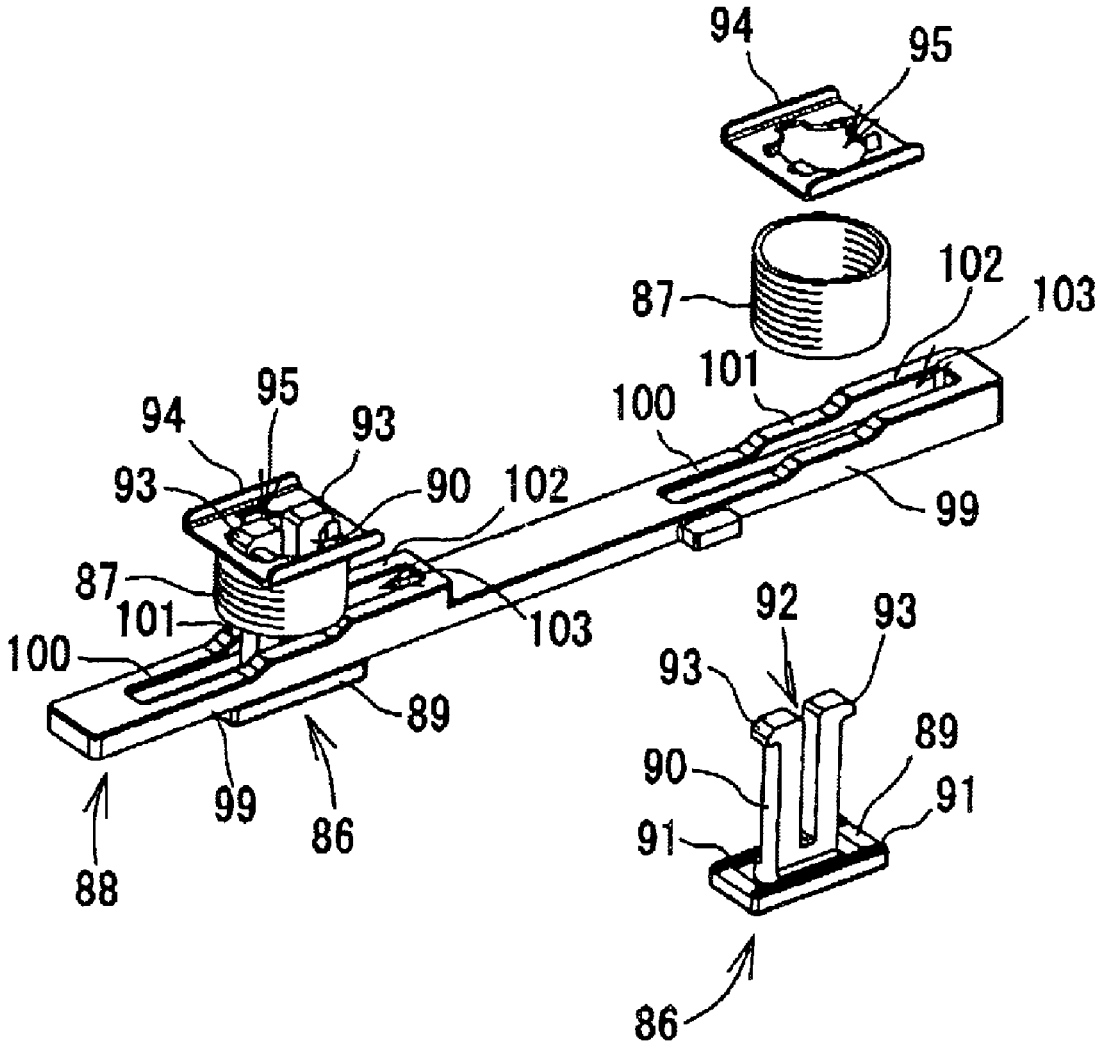
FIG. 11 is an exploded perspective view showing a sliding member 86, a coil spring 87, and a gap adjusting member 88 of the carriage 38.

As shown in FIG. 11, each of the two sliding members 86 includes an elongate contact plate 89 having, as a lower surface thereof, a sliding surface that slides on the guide frame 44; and two leg portions 90 projecting perpendicularly from an upper surface of the contact plate 89. The elongate contact plate 89 is constituted by a rectangular flat plate whose width is substantially equal to a width of the gap-adjusting member 88, and is slid on the guide frame 44 in a state in which the lower surface of the contact plate 89 is contacted with the horizontal, upper surface of the guide frame 44. A pair of elongate ridges 91 are formed on the upper surface of the elongate contact plate 89, such that the two elongate ridges 91 extend parallel to each other along two long sides of the elongate contact plate 89, respectively. In a state in which a lower surface of the elongate gap-adjusting member 88 is uniformly contacted with the respective pairs of ridges 91 of the respective contact plates 89 of the two sliding members 86, the respective lower surfaces of the respective contact plates 89 are maintained parallel to the horizontal upper surface of the guide frame 44 and are positioned relative thereto in the vertical direction perpendicular to the horizontal upper surface.

The two leg portions 90 project from a central portion of the upper surface of the contact plate 89, in a direction substantially perpendicular to the upper surface. The two leg portions 90 have a flat shape extending in a lengthwise direction of the contact plate 89, and a guide groove 92 is formed between the two leg portions 90, such that the guide groove 92 extends in the direction of projection of the leg portions 90 and opens between respective end faces (i.e., respective upper end faces in FIG. 11) of the same 90. The main frame 85 has, as two fitting portions, two fitting ribs 98 (described later) that fit in the respective guide grooves 92 of the two sliding members 86, so that the two fitting ribs 98 (or the main frame 85) are movable upward and downward relative to the two sliding members 86, respectively, while being guided by the corresponding guide grooves 92. The leg portions 90 have, at the respective free end portions thereof, two projections 93 as first biasing-member holding portions that project in opposite directions, respectively, parallel to the lengthwise direction of the contact plate 89 and that cooperate with each other to hold a holding plate 94. The holding plate 94 has a through-hole 95 through which the leg portions 90 are passed. A size of the through-hole 95 is smaller than a distance between respective free ends of the two projections 93. In a state which the two leg portions 90 are elastically deformed such that the width of the guide groove 92 is decreased and accordingly the distance between the respective free ends of the two projections 93 is decreased, the projections 93 are passed through the through-hole 95 of the holding plate 94 and then the leg portions 90 are elastically returned to their original shape, so that the respective free ends of the two projections 93 engage opposite portions of an inner periphery of the holding plate 94 that defines the through-hole 95. Thus, the leg portions 90 are prevented from coming off the through-hole 95 of the holding plate 94, and the sliding member 86 is engaged with the holding plate 94.

As shown in FIG. 10, the main frame 85 has, in a downstream-side portion thereof with respect to the sheet-convey direction, two holding portions 96 as second biasing-member holding portions, at respective positions distant from each other in the reciprocating direction of the carriage 38 (i.e., in leftward and rightward directions in FIG. 10). The two holding portions 96 cooperate with the two holding plates 94 (or the two projections 93) to hold the two compression coil springs 87, respectively. Thus, the main frame 85 is biased downward by the coil springs 87, such that the main frame 85 is movable upward and downward relative to the sliding members 86 engaged with the holding members 94. Each of the two holding portions 96 is constituted by a recessed portion defining a circular recess whose inner diameter is somewhat larger than an outer diameter of each compression coil spring 87. A through-hole 97 is formed through a thickness of a bottom wall of each holding portion (i.e., each recessed portion) 96, and the leg portions 90 of the corresponding sliding member 86 are passed. Each of the two fitting ribs 98 of the main frame 85 projects horizontally into the through-hole 97 of the corresponding holding portion 96, so that the each fitting rib 98 fits in the guide groove 92 of the corresponding sliding member 86. In the state in which the two fitting ribs 98 of the main frame 85 fit in the respective guide grooves 92 of the two sliding members 86, the two sliding members 86 cooperate with each other to support the main frame 85 such that the main frame 85 is movable upward and downward relative to the guide frame 44 while the respective movements of the two fitting ribs 98 are guided by the two guide grooves 92.

As shown in FIGS. 10 and 11, the gap-adjusting member 88 is constituted by an elongate and thick plate-like member, and is provided between respective lower surfaces of the two holding portions 96 of the main frame 85 and the respective pairs of ridges 91 of the respective contact plates 89 of the two sliding members 86. The gap-adjusting member 88 has two adjustment portions 99 at respective locations distant from each other in a lengthwise direction of the member 88. Each of the two adjustment portions 99 includes three stepped portions 100, 101, 102 that are arranged in the lengthwise direction of the gap-adjusting member 88, i.e., in the reciprocating direction of the carriage 38, and that have respective different thickness values in the vertical direction. More specifically described, the three stepped portions 100, 101, 102 include a thin portion 100, a medium-thickness portion 101, and a thick portion 102 that are arranged adjacent each other in the order of description so that the thickness of the each adjustment portion 99 is gradually changed in one direction. Each of the three stepped portions 100, 101, 102 has a horizontal, upper surface whose length in the lengthwise direction of the adjusting member 88 is somewhat greater than a total dimension of the two leg portions 90 and the guide groove 92 in the lengthwise direction of the contact plate 89. Each of a boundary between the thin portion 100 and the medium-thickness portion 101 and a boundary between the medium-thickness portion 101 and the thick portion 102 is smoothly inclined to moderate the change of thickness of each adjustment portion 99.

The elongate gap-adjusting member 88 has, in each of the two adjustment portions 99 thereof, an elongate guide hole 103 that is formed, in a middle portion of the each adjustment portion 99 in the widthwise direction of the adjusting member 88, through the thickness of the adjusting member 88 as a dimension thereof, and that continuously extends over the three stepped portions 100, 101, 102. A width of each of the two elongate guide holes 103 in the widthwise direction of the adjusting member 88 is substantially equal to the thickness of the leg portions 90 of the corresponding sliding member 86, and the leg portions 90 are passed through the each guide hole 103. As shown in FIG. 10, the respective free end portions of the leg portions 90 passed through the elongate guide hole 103 of the gap-adjusting member 88 is further passed through the through-hole 97 of the corresponding holding portion 96 of the main frame 85 while the corresponding fitting rib 98 fits in the guide groove 92 between the leg portions 90. Then, as shown in FIGS. 10 and 11, the respective projections 93 of the two leg portions 90 are engaged with the holding plate 94.

The coil spring 87 is provided between the holding plate 94 and the holding portion 96, and applies a downward-direction elastic biasing force to the holding portion 96 or the main frame 85. Thus, owing to the elastic biasing force, the fitting rib 98 of the holding portion 96 is biased, in the guide groove 92 of the sliding member 86, toward the lowest position thereof relative to the same 86. In addition, since the gap-adjusting member 88 is provided between the fitting rib 98 and the contact plate 89, the fitting rib 98 is moved, against the downward-direction biasing force of the coil spring 87, in an upward direction by a distance equal to the thickness of the adjustment portion 99 of the adjusting member 88. Since the adjustment portion 99 has the continuous elongate hole 103, as described above, the gap-adjusting member 88 is slideable in the state in which the leg portions 90 of the sliding member 86 extend through the elongate hole 103. As the gap-adjusting member 88 slides, the thickness of a portion of the adjustment portion 99 that is located between the fitting rib 98 and the contact plate 89 stepwise changes and accordingly the height position of the fitting rib 98 relative to the contact plate 89 stepwise changes.

In addition, since the sliding member 86 has the leg portions 90 projecting from the central portion of the contact plate 89 and the leg portions 90 extend through the elongate hole 103 of the gap-adjusting member 88, the biasing force of the coil spring 87 is applied via the holding plate 94 and the leg portions 90 to the central portion of the contact plate 89. Thus, owing to the biasing force of the coil spring 87, respective postures of the sliding member 86 and the gap-adjusting member 88 are stabilized. The biasing force of the coil spring 87 is so adjusted as to overcome an angular moment produced when the sliding member 86 slides on the guide member 44, and allow the sliding movement of the gap-adjusting member 88.

Since the fitting rib 98 fits in the guide groove 92 between the leg portions 90 of the sliding member 86, the sliding member 86 is positioned relative to the main frame 85 with respect to the direction of sliding of the gap-adjusting member 88, i.e., the reciprocating direction. In addition, since the leg portions 90 extend through the elongate hole 103 of the adjustment portion 99 of the gap-adjusting member 88, the sliding member 86 is positioned relative to the adjusting member 88 with respect to the sheet-convey direction. Since the gap-adjusting member 88 is positioned relative to the main frame 85 in the sheet-convey direction by a positioning device 108 as shown in FIG. 9, the sliding member 86 is positioned relative to the main frame 85 in the same direction. The positioning device 108 includes a pair of ribs (not shown) that are respectively provided in two portions of the main frame 85 that are located on upstream and downstream sides of the gap-adjusting member 88 in the sheet-convey direction. Moreover, since the upper surface of the contact plate 89 is held in pressed contact with the lower surface of the gap-adjusting member 88, the lower surface (i.e., sliding surface) of the contact plate 89 is positioned relative to the upper surface of the guide frame 44 such that the lower and upper surfaces of the contact plate 89 extend parallel to each other. The gap-adjusting member 88 is positioned by the two holding portions 96 with respect to a vertically upward direction. In addition, the main frame 85 has another pair of ribs (not shown) that position, at each of the three reciprocating-direction positions of the gap-adjusting member 88 relative to the main frame 85, the gap-adjusting member 88 such that the gap-adjusting member 88 is not largely deviated relative to the main frame 85 in the vertically upward direction. Thus, when the three fitting ribs 98 or the main frame 85 is moved upward and downward relative to the two guide frames 43, 44, the three sliding members 86 are not twisted or rotated, and the main frame 85 is supported by the sliding members 86 such that the main frame 85 keeps a horizontal posture. In addition, since the three fitting ribs 98 of the main frame 85 fit in the respective guide grooves 90 of the three sliding members 86 such that the main frame 85 is movable upward and downward, and are held in contact with the three adjustment portions 99 of the two gap-adjusting members 88, respectively, the main frame 85 can be moved upward and downward by a small amount of movement of the carriage 38 in the reciprocating direction thereof.

As shown in FIGS. 8 and 10, the gap-adjusting member 88, provided between the two sliding members 86 and the two fitting ribs 98, has, in the direction of sliding thereof, a length (i.e., a dimension) greater than a length (i.e., a dimension) of the main frame 85, so that lengthwise opposite ends of the adjusting member 88 can simultaneously project outward from the main frame 85. Meanwhile, the two guide frames 43, 44 have respective pairs of engageable portions 106, 107 (FIG. 4) each pair of which are formed by cutting and bending lengthwise opposite end portions of a corresponding one of the two frame 43, 44. When respective one engageable portions 106, or 107, of the two guide frames 43, 44 engage respective ends of the two gap-adjusting members 88, respective positions of the two adjusting members 88 relative to the main frame 85 are changed. However, the engageable portions 106, 107 are not limited to the cut and bent end portions of the guide frames 43, 44, but may be provided by a portion of the frame structure of the MFD 1, or exclusive engageable members provided at appropriate positions.

As shown in FIGS. 8 and 9, one sliding member 86, one coil spring 87, and one gap-adjusting member 88 are provided on the side of the upstream-side end portion of the main frame 85 of the carriage 38, and two sliding members 86, two coil springs 87, and one gap-adjusting member 88 are provided on the side of the downstream-side end portion of the main frame 85. The main frame 85 has the three holding portions 96 that hold the respective coil springs 87, and accordingly is movable upward and downward according to the respective positions of the two gap-adjusting members 88 in the reciprocating direction. The one gap-adjusting member 88 provided on the side of the upstream-side end portion of the main frame 85 has, in a lengthwise middle portion thereof, one adjustment portion (not shown) identical with each adjustment portion 99 shown in FIG. 11. Each of the three coil springs 87 applies a biasing force to a corresponding one of the three sliding members 86, such that the upper surface of the contact plate 89 of the corresponding sliding member 86 closely contacts the lower surface of a corresponding one of the two gap-adjusting members 88. In addition, a portion (e.g., a half portion) of a self weight of the carriage 38 is applied to the corresponding gap-adjusting member 88. Thus, at least one of (a) the biasing force(s) of one or two coil springs 87 that is/are applied to the corresponding gap-adjusting member 88 and (b) the portion of the self weight of the carriage 38 that is applied to the corresponding gap-adjusting member 88 is so selected as to assure that, when the carriage 38 is reciprocated, the corresponding gap-adjusting member 88 is prevented from being moved by an inertia thereof relative to the corresponding sliding member 86 and the main frame 85 in the reciprocating direction, owing to a frictional force produced between (c) each of the corresponding sliding member 86 and the main frame 85 and (b) the corresponding gap-adjusting member 88.

When the carriage 38 is moved in the reciprocating direction so that the two gap-adjusting members 88 are concurrently engaged with the two engageable portions 106 or the two engageable portions 107, respectively, and are concurrently moved relative to the main frame 85 in the reciprocating direction, the three adjustment portions 99 of the two gap-adjusting members 88 are translated relative to the main frame 85 and accordingly a positional relationship between the three adjustment portions 99 is not changed. Therefore, the three holding portions 96 or the three fitting portions 98 are not moved relative to each other in the vertical direction. Thus, the main frame 85 is always kept parallel to the respective upper surfaces of the two guide frames 43, 44, and is moved upward and downward in a state in which the posture of the ink-jet recording head 39 mounted on the main frame 85 is kept horizontal. Therefore, the lower surface of the ink-jet recording head 39 and the recording sheet temporarily stopped on the platen 42 can be kept parallel to each other in the image recording area, that is, the gap between the lower surface of the ink-jet recording head 39 and the recording sheet can be kept constant in the image recording area. Thus, an image or images can be accurately recorded on the recording sheet. However, the total number of the sliding members 86 may be changed, as needed. For example, two sliding members 86 may be also provided on the side of the upstream-side end portion of the main frame 85 with respect to the direction of conveying of recording sheet.

As shown in FIG. 9, the main frame 85 has three support portions 104 each of which projects downward from the lower surface of the main frame 85 and is located inside a corresponding one of the three sliding members 86. The three support portions 104 can rest on the respective upper surfaces of the two guide frames 43, 44 and thereby define a height position of the main frame 85, when the three sliding members 86 are moved upward by respective maximum distances relative to the main frame 85.

In addition, as shown in FIG. 9, the downstream-side end portion of the main frame 85 has a L-shaped projecting portion 105 that first projects downward from the lower surface of the main frame 85 and then projects inward like a hook. In a state in which the carriage 38 is placed on the two guide frames 43, 44, the hook-like free end of the L-shaped portion 105 is located below the lower surface of the guide frame 44 with an appropriate clearance left therebetween. Therefore, if the carriage 38 jumps off the guide frame 44, the free end of the L-shaped projecting portion 105 may engage the lower surface of the guide frame 44, thereby stopping a further jumping of the carriage 38. Thus, the carriage 38 is held by the guide frame 44 such that appropriate amounts of rattling of the carriage 38 are allowed in the vertical direction.

The reciprocation of the carriage 38 constructed as described above is controlled by the control device 64. In particular, the control device 64 operates for controlling the movement of the carriage 38 so as to cause the respective one ends, or respective other ends, of the two gap-adjusting members 88 to be concurrently engaged with the two engageable portions 106, or the two engageable portions 107, and thereby change the respective positions of the two adjusting members 88 relative to the main frame 85. This operation will be described in detail, below.

As shown in FIG. 4, the carriage 38 carrying the inkjet recording head 39 is placed on the two guide frames 43, 44 such that the carriage 38 bridges the two guide frames 43, 44, and is reciprocated, under the control of the control device 64, in the reciprocating direction perpendicular to the direction of conveying of recording sheet. While the carriage is reciprocated, the ink-jet recording head 39 ejects, according to recording-control signals supplied from the control device 64, droplets of inks toward the recording sheet being conveyed on the platen 42.

The main frame 85 carrying the ink-jet recording head 39 is supported by the sliding members 86, or the support portions 104 of the main frame 85, at an appropriate height position relative to the guide frames 43, 44. This height position is selected by the control device 64 based on a thickness of a recording medium used, such as a recording sheet or an envelope, or a resolution of an image to be recorded on a recording medium. In the present embodiment, the height position of the main frame 85 is selected from three steps corresponding to the three stepped portions 100, 101, 102 of each of the adjustment portions 99 of the gap-adjusting members 88, respectively.

The control device 64 controls the driving device 46 to move the carriage 38 to cause the respective one ends, or the respective other ends, of the two gap-adjusting members 88 to be selectively engaged with the two engageable portions 106, or the two engageable portions 107, that are provided at the lengthwise opposite end portions of the two guide frames 43, 44. The control device 64 selects one of the three height positions or steps of the carriage 38, based on a thickness of a recording medium used, or a resolution of an image to be recorded on a recording medium, that is represented by information supplied from, e.g., a printer driver to the MFD 1. Generally, when the recording medium used is a thick paper or an envelope, the control device 64 increases the height position of the carriage 38 so as to move the ink-jet recording head 39 away from the platen 42; on the other hand, when the resolution of image is high, i.e., when the size of ink droplets ejected from the recording head 39 is small, the control device 64 decreases the height position of the carriage 38 so as to move the recording head 39 toward the platen 42. Thus, the control device 64 automatically selects the height position of the carriage 38 according to a predetermined relationship between thickness of recording medium and/or resolution of image and height position, that is stored in the ROM 66.

In the present embodiment, it is assumed that in a neutral state shown in FIGS. 8, 9, and 10, the height position of the carriage 38 is selected at the middle one of the three height steps. That is, the respective medium-thickness portions 101 of the three adjustment portions 99 of the two gap-adjusting members 88 are interposed between the three fitting ribs 98 and the respective contact plates 89 of the three sliding members 86. In this state, the respective lower surfaces of the three contact plates 89 project downward beyond respective lower ends of the three support portions 104 of the main frame 85, so that the main frame 85 is supported by the three sliding members 86 at the middle one of the three height positions. In this state, a distance between the respective lower surfaces of the respective contact plates 89 of the two sliding members 86 placed on the downstream-side guide frame 44, i.e., the upper surface of the guide frame 44, and the lower surface of the ink-jet recording head 39 is indicated by D1; and a distance between the lower surface of the ink-jet recording head 39 and the upper surface of the platen 42 is indicated by D2. In FIGS. 9 through 15, the two guide frames 43, 44 and the platen 42 are omitted.

When the height position of the carriage 38 is increased, the control device 64 moves the carriage 38 toward the side (i.e., the right-hand side in FIG. 4) on which the cap member 52 is located, by rotating the CR motor 73 in an appropriate direction. When the carriage 38 is slid on the two guide frames 43, 44 toward the cap member 52, and is positioned right above the cap member 52, the cap member 52 is moved upward to contact closely the lower surface of the ink-jet recording head 39. Consequently the carriage 38 is more or less moved upward, but this upward movement is limited within an appropriate range by the above-described L-shaped projecting portion 105.

Figure 12:
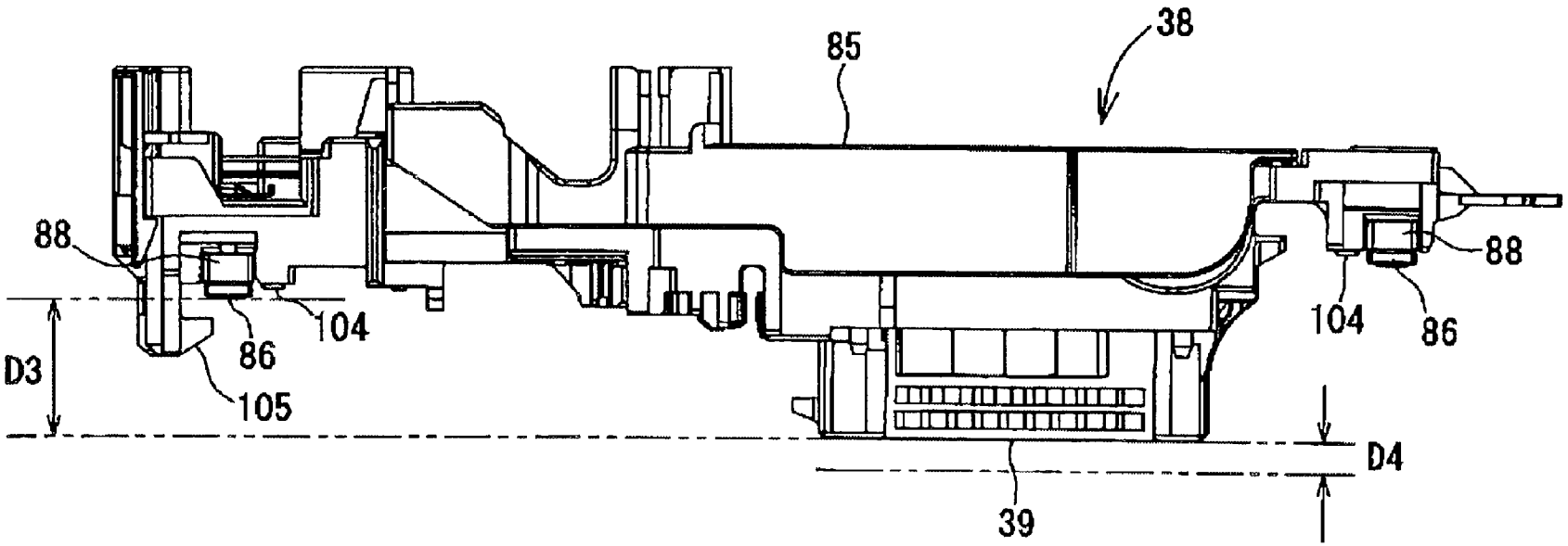
FIG. 12 is another side elevation view of the carriage 38.
Figure 13:
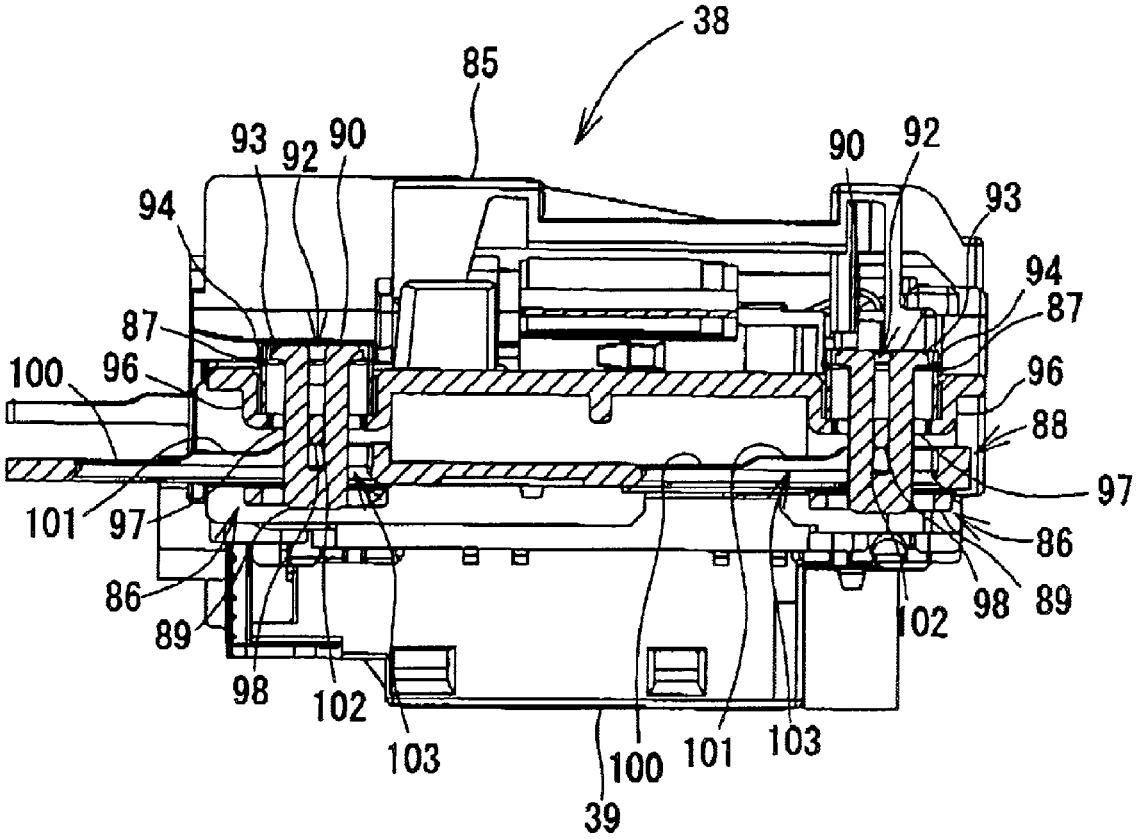
FIG. 13 is another cross-sectional view corresponding to FIG. 10.

When the carriage 38 is moved to the position above the cap member 52, the respective one end portions (i.e., the respective right-hand end portions in FIG. 4) of the two gap-adjusting members 88 that project outward from the main frame 85 are engaged with the two engageable portions 106. If the carriage 38 is further moved, the two gap-adjusting members 88 are slid, as shown in FIG. 13, relative to the main frame 85 in the leftward direction, so that the respective right-hand end portions of the two adjusting members 88 are retracted into the main frame 85. Consequently the respective thick portions 102 of the three adjustment portions 99 of the two gap-adjusting members 88 are interposed between the three fitting ribs 98 and the respective contact plates 89 of the three sliding members 86. In this state, the respective lower surfaces of the three contact plates 89 project downward beyond the respective lower ends of the three support portions 104 of the main frame 85, as shown in FIG. 12, so that the main frame 85 is supported by the three sliding members 86 at the highest one of the three height positions.

Owing to an inertia of the carriage 38 sliding on the two guide frames 43, 44 while receiving the driving force of the CR motor 73, the two gap-adjusting members 88 are slid in the direction to increase the distances between the three fitting ribs 98 and the three contact plates 89, against the respective biasing forces of the coil springs 87 and the weight of the carriage 38. Since, however, the cap member 52 closely contacts the lower surface of the ink-jet recording head 39 and accordingly the carriage 38 is somewhat pushed in an upward direction away from the two guide frames 43, 44, as described above, the weight of the carriage 38 does not apply to the gap-adjusting members 88 when the members 88 are slid relative to the main frame 85. Thus, a torque that is needed by the CR motor 73 to slide the gap-adjusting members 88 relative to the main frame 85 is reduced.

In this state, a distance between the respective lower surfaces of the two contact plates 89, i.e., the upper surface of the guide frame 44, and the lower surface of the ink-jet recording head 39 is indicated by D3; and a distance between the lower surface of the ink-jet recording head 39 and the upper surface of the platen 42 is indicated by D4. Since the sliding members 86 project downward by a greater distance from the main frame 85, the main frame 85 is moved vertically upward away from the guide frames 43, 44, and the lower surface of the ink-jet recording head 39 is moved away from the platen 42. Therefore, the distance D1 is greater than the distance D3 (i.e., D1>D3), and the distance D2 is smaller than the distance D4 (i.e., D2<D4). Thus, when a thick recording medium is conveyed onto the platen 42, the recording medium can be prevented from interfering with the recording head 39. In addition, the distance or gap between the recording head 39 and each sort of recording medium that is changed depending upon thickness values of different sorts of recording media can be adjusted by adjusting the height position of the main frame 85.

Figure 14:
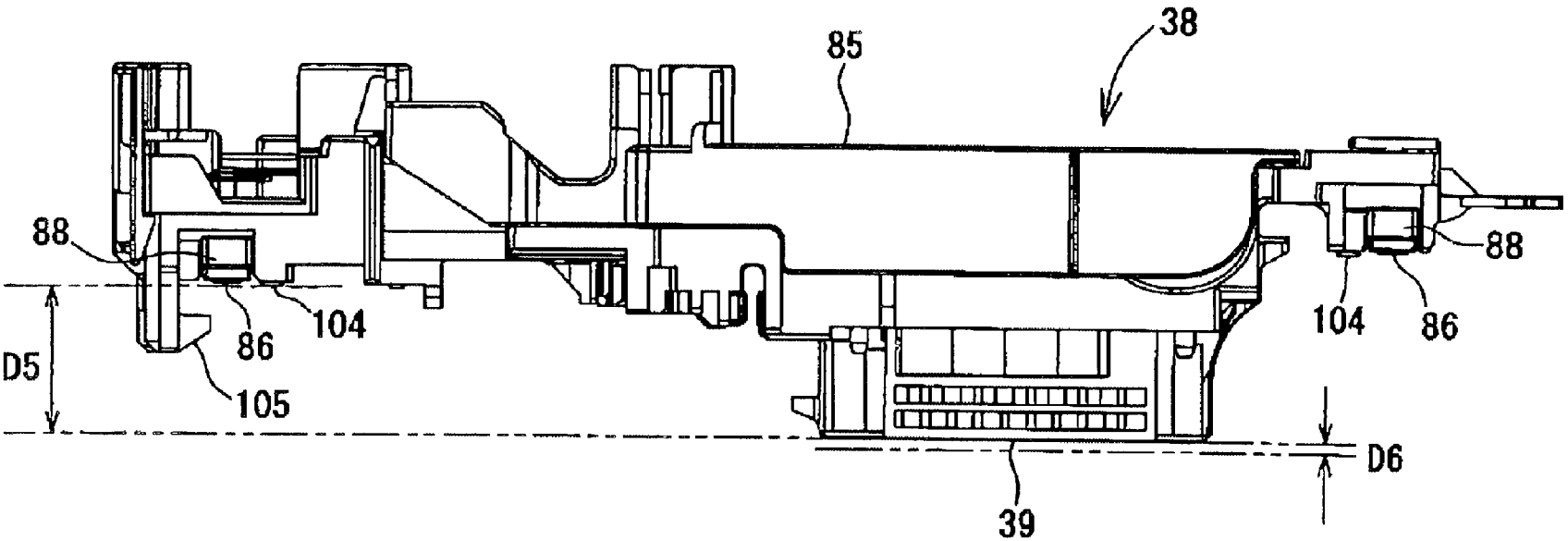
FIG. 14 is another side elevation view of the carriage 38.
Figure 15:
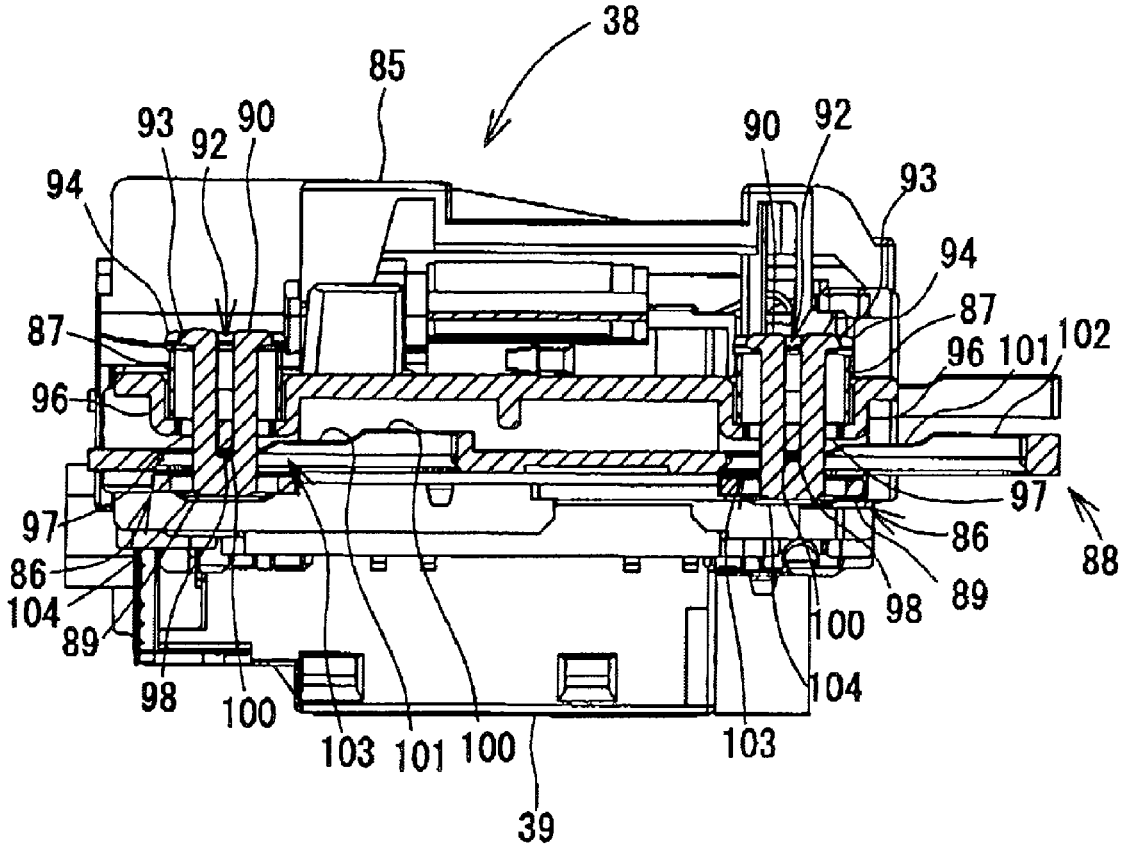
FIG. 15 is another cross-sectional view corresponding to FIG. 10.

When the height position of the main frame 85 of the carriage 38 is decreased, the control device 64 moves the carriage 38 toward the side (i.e., the left-hand side in FIG. 4) on which the waste-ink tray 84 is provided, by rotating the CR motor 73 in the opposite direction. When the carriage 38 is moved on the two guide frames 43, 44 toward the waste-ink tray 84, the respective other end portions (i.e., the respective left-hand end portions in FIG. 4) of the two gap-adjusting members 88 that project out of the main frame 85 are engaged with the two engageable portions 107. If the carriage 38 is further moved, the two gap-adjusting members 88 are slid, as shown in FIG. 15, relative to the main frame 85 in the rightward direction, so that the respective left-hand end portions of the two adjusting members 88 are retracted into the main frame 85. Consequently the respective thin portions 100 of the three adjustment portions 99 of the two gap-adjusting members 88 are interposed between the three fitting ribs 98 and the respective contact plates 89 of the three sliding members 86. In this state, the respective lower surfaces of the three contact plates 89 are retracted upward to respective positions above the respective lower ends of the three support portions 104 of the main frame 85, as shown in FIG. 14, so that the main frame 85 is supported by the three support portions 104 at the lowest one of the three height positions.

In this state, a distance between the respective lower surfaces of the two support portions 104 placed on the guide frame 44, i.e., the upper surface of the guide frame 44, and the lower surface of the ink-jet recording head 39 is indicated by D5; and a distance between the lower surface of the ink-jet recording head 39 and the upper surface of the platen 42 is indicated by D6. Since the sliding members 86 are retracted into the main frame 85, the main frame 85 is moved vertically downward toward the guide frames 43, 44, and the lower surface of the ink-jet recording head 39 is moved toward the platen 42. Therefore, the distance D5 is greater than the distance D1 (i.e., D5>D1), and the distance D2 is greater than the distance D6 (i.e., D2>D6). Thus, the ink-jet recording head 39 can advantageously eject small droplets of inks toward the recording medium so as to record, at a high resolution, an image on the medium. In the present embodiment, when the carriage 38 is positioned at the lowest height position, the sliding members 86 are completely retracted into the main frame 85, and the carriage 38 is supported by the support portions 104 of the main frame 85 on the guide frames 43, 44. However, the support portions 104 may not be provided on the main frame 85. In the latter case, when the carriage 38 is positioned at the lowest height position, the carriage 38 or the main frame 85 is supported by the three sliding members 86 on the two guide frames 43, 44.

In the above-described first embodiment, the control device 64, the driving device 46, the three sliding members 86, the three coil springs 87, the two gap-adjusting members 88, the three holding portions 96, and the two pairs of engageable portions 106, 107 cooperate with each other to provide a gap adjusting device.

As is apparent from the foregoing description of the MFD 1 as the first embodiment, the main frame 85 of the carriage 38 that carries the ink-jet recording head 39 is supported at an appropriate height position relative to the two guide frames 43, 44, by the three sliding members 86, the three coil springs 87, and the two gap-adjusting members 88 provided between the three fitting ribs 98 of the main frame 85 and the respective contact plates 89 of the three sliding members 86, and the appropriate height position of the main frame 85 can be changed by sliding the gap-adjusting members 88 relative to the main frame 85 and the sliding members 86 and thereby changing the distance between the fitting ribs 98 and the contact plates 89. Therefore, the gap between the ink-jet recording head 39 and the recording medium or the platen 42 can be adjusted based on the thickness of the recording medium to be used, or the resolution of images to be recorded on the medium.

Second Embodiment

Figure 16:
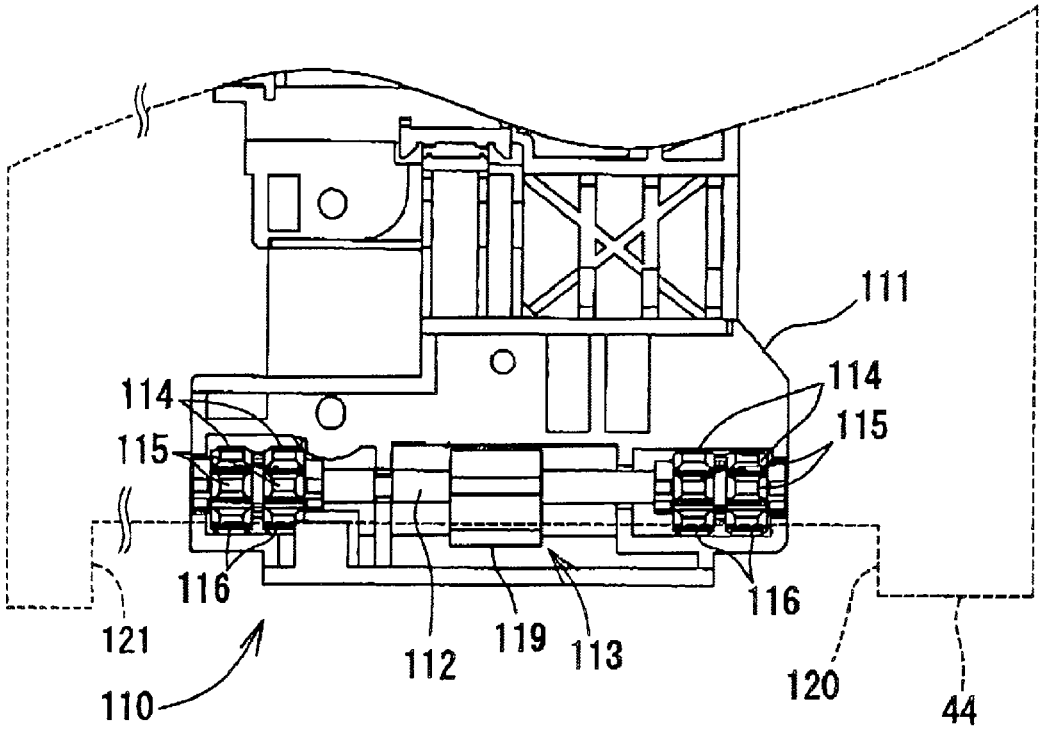
FIG. 16 is a bottom view showing a portion of a lower surface of a carriage 110 of another printer portion as a second embodiment of the present invention.

The second embodiment also relates to an MFD (multi-function device) that has the same construction as that of the MFD 1 as the first embodiment, except for a carriage 110 and two pairs of engageable portions 120, 121 shown in FIGS. 16 through 19 (only one pair of engageable portions 120, 121 are shown in FIGS. 16). Therefore, the following description relates to only differences of the carriage 110 and the two pairs of engageable portions 120, 121 from the carriage 38 and the two pairs of engageable portions 106, 107 of the MFD 1. The same reference numerals as used in the first embodiment are used to designate the corresponding elements or parts of the second embodiment and the description thereof is omitted. The carriage 110 includes two rotatable shaft members 112, and two slider bodies 113 as input members. In FIG. 16, an upstream-side half portion of the carriage 110 with respect to a direction of conveying of recording sheet is omitted and accordingly only one rotatable shaft member 112 and only one slider body 113 are shown.

As shown in FIG. 16, the carriage 110 includes a main frame 111 on which the ink-jet recording head 39 is mounted; the two rotatable shaft members 112 that slide on the two guide frames 43, 44, respectively, and cooperate with each other to support the main frame 111 at each of different height positions; and the two slider bodies 113 that are moved to rotate the two rotatable shaft members 112, respectively. The two rotatable shaft members 112 and the two slider bodies 113 are provided in the upstream-side and downstream-side end portions of the main frame 111 with respect to the sheet-convey direction, such that the two rotatable shaft members 112 and the two slider bodies 113 correspond to the two guide frames 43, 44, respectively. Since, however, the two rotatable shaft members 112 have an identical construction and the two slider bodies 113 have an identical construction, the following description relates only to one rotatable shaft member 112 and one slider body 113 that are provided in the downstream-side end portion of the main frame 111.

Figure 17:
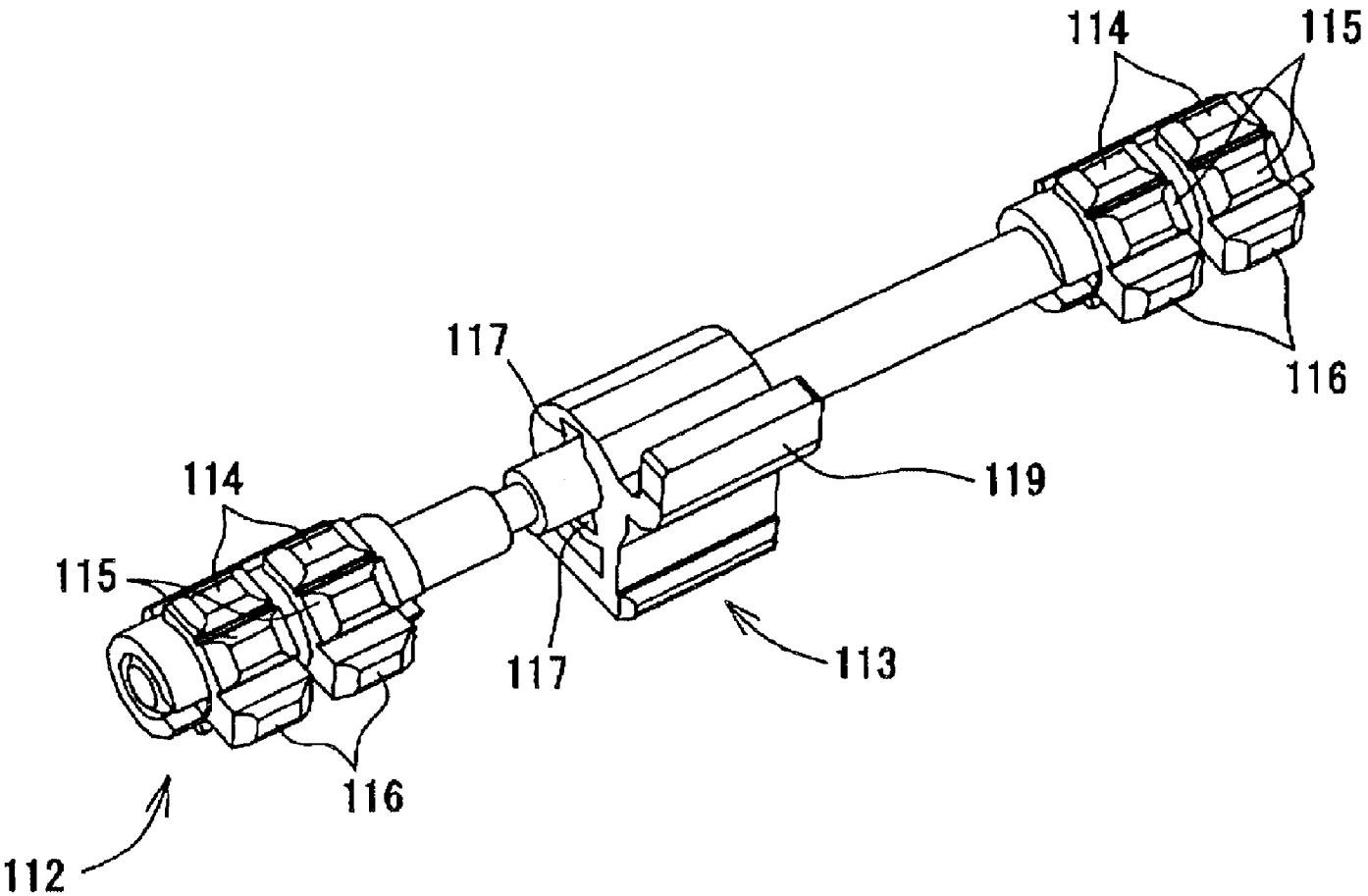
FIG. 17 is a perspective view showing respective external constructions of a rotatable shaft member 112 and a slider body 113 of the carriage 110.

As shown in FIGS. 16 and 17, the rotatable shaft member 112 has an axial length substantially equal to a width of the main frame 111 in the reciprocating direction of the carriage 110 (i.e., leftward and rightward directions in FIG. 16). The rotatable shaft member 112 is supported by a lower end portion of the main frame 111 such that an axial direction of the shaft member 112 is parallel to the reciprocating direction of the carriage 110 and such that the shaft member 112 is rotatable about an axis line thereof. Each of axially opposite end portions of the rotatable shaft member 112 supports three sliding blocks 114, 115, 116 as a group of sliding portions, such that the three sliding blocks 114, 115, 116 project radially outward by different amounts or distances from an outer circumferential surface of the shaft member 112.

The respective distances of projection of the three sliding blocks 114, 115, 116 radially outward from each of the axially opposite end portions of the rotatable shaft 112 stepwise increase in this order, and the three sliding blocks 114, 115, 116 are arranged in this order in a circumferential direction of the each end portion of the rotatable shaft member 112, such that the two sliding blocks 114 provided at the two end portions are paired and aligned with each other in the axial direction of the shaft member 112, the two sliding blocks 115 are paired and aligned with each other in the same direction, and the two sliding blocks 116 are paired and aligned with each other in the same direction.

Figure 6:
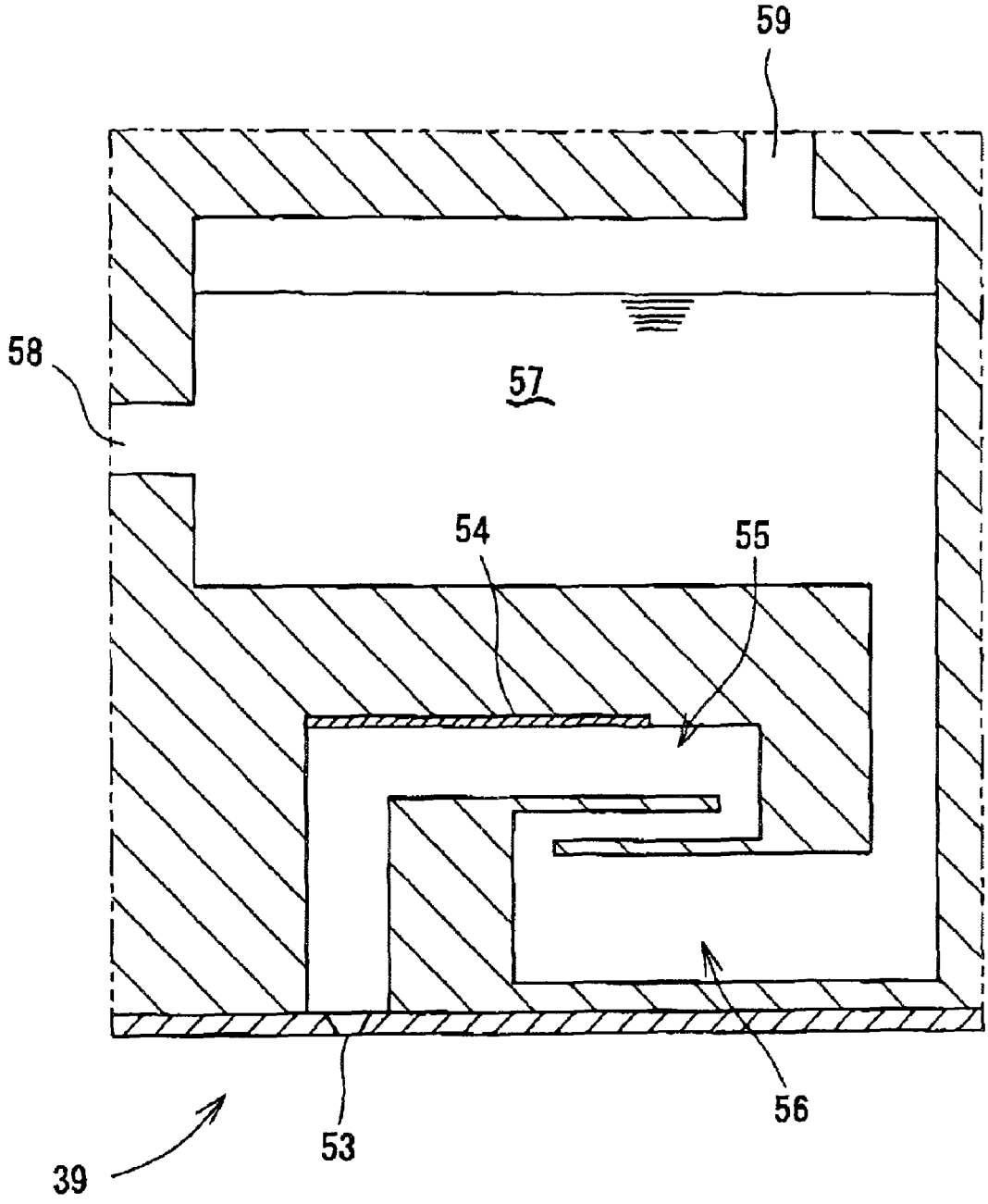
FIG. 6 is an enlarged cross-sectional view showing an internal construction of the ink-jet recording head 39.

As shown in FIG. 6, the rotatable shaft member 112 is supported by the downstream-side end portion of the main frame 111 such that an arbitrary one pair of sliding blocks out of the three pairs of sliding blocks 114, 115, 116 project vertically downward from the main frame 111. When the arbitrary one pair of sliding blocks 114, 115 or 116 project downward from the downstream-side end portion of the main frame 111, a corresponding sort and pair of sliding blocks 114, 115 or 116 project downward from the upstream-side end portion of the main frame 111, so that the main frame 111 is horizontally supported on the two guide frames 43, 44. Thus, when the two pairs of sliding blocks 114, 115, or 116 are slid on the two guide frames 43, 44, respectively, the carriage 110 is reciprocated in the manner described above in connection with the first embodiment shown in FIGS. 1 through 15.

Figure 18:
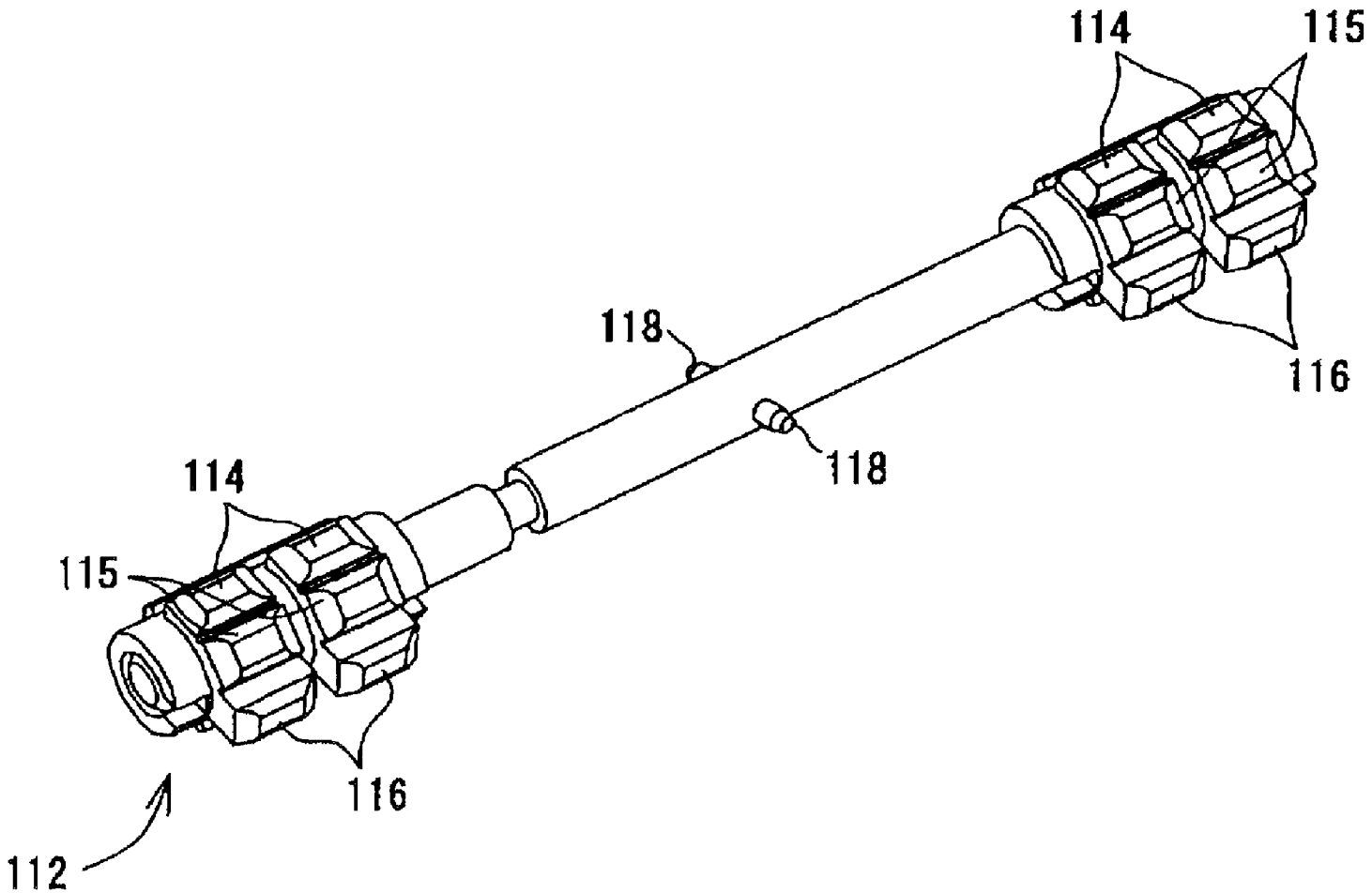
FIG. 18 is a perspective view showing the external construction of the rotatable shaft member 112.

The slider body 113 is externally fitted on an axially intermediate portion of each of the two rotatable shaft members 112. The slider body 113 is constituted by a tubular member that is slideable along the outer circumferential surface of the rotatable shaft member 112 in the axial direction thereof. As shown in FIG. 17, the slider body 113 has a pair of spiral cam grooves 117 formed in an inner circumferential surface thereof. As shown in FIG. 18, each rotatable shaft member 112 has a pair of cam-follower projections 118 projecting radially outward from the outer circumferential surface of the axially intermediate portion thereof. The slider body 113 fits on the rotatable shaft member 112 such that the two cam-follower projections 118 fit in the two spiral cam grooves 117, respectively. When the slider body 113 is slid in the axial direction of the rotatable shaft member 112, the cam-follower projections 118 are moved in the cam grooves 117, respectively, while rotating the shaft member 112. That is, the sliding or linear movement of the slider body 113 is converted into the rotation of the rotatable shaft member 112 by the cam-follower projections 118 and the cam grooves 117.

As shown in FIG. 17, the slider body 113 has a projecting portion 119 that has an L-shaped cross section and that projects outward of the tubular, base portion thereof in a direction perpendicular to the axis line of the rotatable shaft member 112. In the state, shown in FIG. 16, in which the rotatable shaft member 112 and the slider body 113 are supported by the main frame 111, the projecting portion 119 projects downward from the lower end portion of the main frame 111. When the carriage 110 moves to a predetermined position on the two guide frames 43, 44, the respective projecting portions 119 of the two slider bodies 113 are engaged with the two first engageable portions 120 formed by cutting away respective first portions of the two guide frames 43, 44 (only one engageable portion 120 is shown in FIG. 16). If the carriage 110 is further moved, the two slider bodies 113 are slid in the respective axial directions of the two rotatable shaft members 112. The two guide frames 43, 44 have the respective second engageable portions 121 formed by cutting away respective second portions thereof that are opposite to the respective first portions thereof in the reciprocating direction of the carriage 110 (only one engageable portion 121 is shown in FIG. 16).

Figure 19:
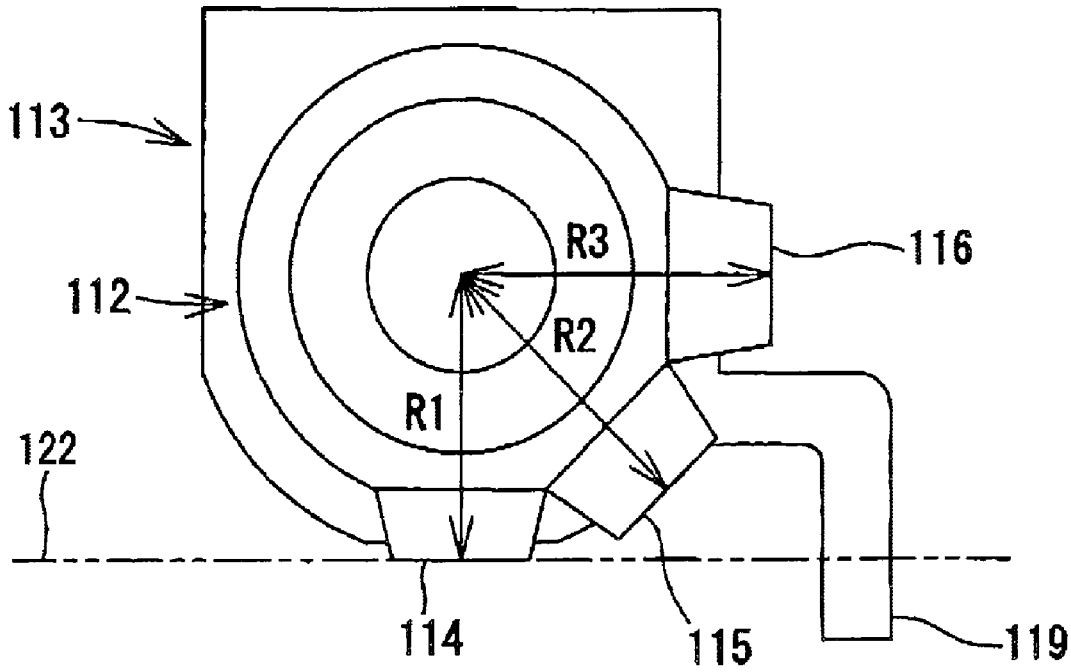
FIG. 19 is a side elevation view of the rotatable shaft member 112 and the slider body 113.

The control device 64 operates for controlling the driving device 46 to move the carriage 110 so as to cause the two slider bodies 113 to be concurrently engaged with the two engageable portions 120 or the two engageable portions 121 and thereby change respective rotation positions (i.e., respective angular phases) of the two rotatable shaft members 112. As shown in FIG. 19, each of the two pairs of sliding blocks 114 has a smallest distance, R1, between the axis line of the corresponding rotatable shaft member 112 and an end surface thereof; each of the two pairs of sliding blocks 115 has an intermediate distance, R2, between the axis line of the corresponding rotatable shaft member 112 and an end surface thereof; and each of the two pairs of sliding blocks 116 has a greatest distance, R3, between the axis line of the corresponding rotatable shaft member 112 and an end surface thereof. Therefore, when the four sliding blocks 114 slide on respective upper surfaces 122 of the two guide frames 43, 44, the main frame 111 is supported at the lowest one of three height positions; when the four sliding blocks 115 slide on the two guide frames 43, 44, the main frame 111 is supported at an intermediate one of the three height positions; and when the four sliding blocks 116 slide on the two guide frames 43, 44, the main frame 111 is supported at the highest height position. When the main frame 111 is supported at the lowest height position, the smallest gap is provided between the ink-jet recording head 39 and the recording medium or the platen 42, and an image can be advantageously recorded at a high resolution.

The control device 64 operates the CR motor 73 of the driving device 46 to cause the carriage 110 to slide on the two guide frames 43, 44 in an appropriate direction and thereby cause the two slider bodies 113 to be concurrently engaged with the first or second engageable portions 120, 121 formed in the guide frames 43, 44. Thus, the slider bodies 113 are slid in the respective axial directions of the rotatable shaft members 112. The respective sliding or linear movements of the two slider bodies 113 are converted into the respective rotations of the two rotatable shaft members 112 by the cam grooves 117 and the cam-follower projections 118. If the two slider bodies 113 are slid, and accordingly the two shaft members 112 are rotated, by respective angular amounts assuring that the two pairs of sliding blocks 115 are brought into contact with the respective upper surfaces 122 of the guide frames 43, 44, the carriage 110 is supported at the intermediate height position corresponding to the intermediate distance R2 between the axis line of each rotatable shaft 112 and the end surface of each sliding block 115. Likewise, if the two slider bodies 113 are slid, and accordingly the two shaft members 112 are rotated, by respective angular amounts assuring that the two pairs of sliding blocks 116 are brought into contact with the two guide frames 43, 44, the carriage 110 is supported at the highest position corresponding to the greatest distance R3. Thus, the gap between the ink-jet recording head 39 and the recording medium or the platen 42 can be stepwise increased, and accordingly can be adjusted to any one of the three steps according the thickness of the sort of recording media used. When the two slider bodies 113 are engaged with the respective second engageable portions 121 of the two guide frames 43, 44, the gap between the ink-jet recording head 39 and the recording medium can be stepwise decreased.

In the above-described second embodiment, the two slider bodies 113 having the respective pairs of cam grooves 117 and the respective projecting portions 119, the two rotatable shaft members 112 having the respective pairs of cam-follower projections 118, and the two pairs of engageable portions 120, 121 cooperate with each other to provide a converting device that converts a portion of the reciprocating movement of the carriage 110 into a rotation of each of the two rotatable shaft members 112; and the control device 64, the driving device 46, the two rotatable shaft members 112, the above-indicated converting device, and the two pairs of engageable portions 120, 121 cooperate with each other to provide a gap adjusting device.

As is apparent from the foregoing description of the second embodiment, the three sorts of sliding blocks 114, 115, 116 each sort of which can support the main frame 111 carrying the ink-jet recording head 39, at a corresponding one of the three height positions relative to the two guide frames 43, 44, are arranged in the respective circumferential directions of the two rotatable shaft members 112, such that the three sorts of sliding blocks 114, 115, 116 project radially outward from the shaft members 112 by the different distances R1, R2, R3. When the two slider bodies 113 are concurrently slid and accordingly the two shaft members 112 are concurrently rotated, one sort of sliding blocks 114, 115 or 116 are brought into contact with the two guide frames 43, 44 so that the height position of the main frame 111 is changed or adjusted to an appropriate one of the three steps corresponding to the three distances R1, R2, R3. Thus, the gap between the ink-jet recording head 39 and the recording medium or the platen 42 can be adjusted.

In each of the first and second embodiments, the main frame 85, 111 is translated relative to the two guide frames 43, 44, more specifically, is translated in a vertical direction while the main frame 85, 111 keeps a horizontal posture. However, in each of the first and second embodiments, only one of the two gap-adjusting members 88 may be moved, or only one of the two shaft members 112 may be rotated, to incline the lower surface of the main frame 85, 111 or the lower surface of the ink-jet recording head 39 mounted on the main frame 85, relative to the recording medium or the platen 42 (i.e., a plane defined by the reciprocating direction and the sheet-convey direction) by a small angle not greater than 15 degrees, more preferably, not greater than 10 degrees, or most preferably not greater than 5 degrees.

In each of the first and second embodiments, the ink-jet recording head 39 is mounted on the main frame 85, 111 of the carriage 38, 110. However, any other sort of image recording head may be mounted on the main frame 85, 111.

In the first embodiment, the single sliding member 86 is provided on the side of the upstream-side end portion of the carriage 38, and the two sliding members 86 are provided on the side of the downstream-side end portion of the carriage 38. However, two sliding members 86 may also be provided on the side of the upstream-side end portion of the carriage 38; or only one sliding member 86 may be provided on the side of each of the upstream-side and downstream-side end portions of the carriage 38. In the last case, each of the two sliding members 86 may be so modified as to have a shape elongate in the reciprocating direction of the carriage 38.

In the first embodiment, each of the three sliding members 86 has the guide groove 92, and the main frame 85 has the three fitting ribs 98. However, each of at least two sliding members 86 that are slid on the two guide frames 43, 44, respectively, may have a fitting portion (e.g., an elongate rail), and the main frame 85 may have at least two guide grooves that correspond to the two guide frames 43, 44, respectively, and that guide respective movements of the respective fitting portions of the at least two sliding members 86.

In the first embodiment, the three coil springs 87 are employed. However, those coil springs 87 may be omitted in the case where a self-weight of the main case 85 is sufficiently great.

In the second embodiment, the two groups of sliding blocks 114, 115, 116 are provided on each of the two rotatable shaft members 112. However, two groups of sliding blocks 114, 115, 116 may be provided on one of the two rotatable shaft members 112 and only one group of sliding blocks 114, 115, 116 may be provided on the other of the two rotatable shaft members 112; or only one group of sliding blocks 114, 115, 116 may be provided on each of the two rotatable shaft members 112. In those cases, each of the sliding blocks 114, 115, 116 may be so modified as to have a shape elongate in the reciprocating direction of the carriage 110.

In the second embodiment, the two cam grooves 117 are provided in each of the two slider bodies 113, and the two cam-follower projections 118 are provided on each of the two rotatable shaft members 112. However, one or more cam grooves 117 may be provided in the outer circumferential surface of each of the two rotatable shaft members 112, and one or more cam-follower projections 118 may be provided on the inner circumferential surface of each of the two slider bodies 113.

It is to be understood that the present invention may be embodied with various changes, modifications, and improvements that may occur to a person skilled in the art without departing from the spirit and scope of the invention defined in the appended claims.

What is claimed is:

1. An image recording apparatus, comprising:

a carriage which is reciprocated in opposite directions;

a pair of guide frames which extend parallel to each other in a parallel direction parallel to said opposite directions and which cooperate with each other to guide a reciprocating movement of the carriage, wherein the two guide frames are separate from each other in a conveying direction in which a recording medium is conveyed and which is perpendicular to the parallel direction, and wherein the carriage includes a main frame which is supported by the two guide frames such that the main frame bridges the two guide frames, and additionally includes at least two sliding members, wherein each of said at least two sliding members has a sliding surface which slides on a corresponding one of the two guide frames in each of said opposite directions, and said at least two sliding members cooperate with each other to support the main frame such that the main frame is movable relative to said each of said at least two sliding members in a perpendicular direction perpendicular to the parallel direction and the conveying direction;

an image recording head which is mounted on the main frame of the carriage and which records an image on the recording medium;

a driving device which reciprocates the carriage in said opposite direction; and a gap adjusting device including a control device which controls the driving device to reciprocate the carriage in said opposite directions, a first gap adjusting portion and a second gap adjusting portion which correspond to the two guide frames, respectively, and are separate from each other in the conveying direction and each of which changes, by utilizing a portion of the reciprocating movement of the carriage, a distance between (a) the sliding surface of at least one corresponding sliding member of said at least two sliding members and (b) the main frame in the perpendicular direction and thereby adjusts, in the perpendicular direction, a gap between the recording medium and the image recording head mounted on the main frame, wherein said each of the first gap adjusting portion and the second gap adjusting portion includes:

an adjusting member which is movable relative to the main frame and said at least one corresponding sliding member in said each of said opposite directions, and changes, depending upon a position thereof relative to the main frame and said at least one corresponding sliding member in the parallel direction, a relative position between the main frame and the sliding surface of said at least one corresponding sliding member in the perpendicular direction so as to adjust the gap between the recording medium and the image recording head; and a pair of engageable portions each of which is engageable with a corresponding one of opposite ends in the parallel direction of the adjusting member, so as to move the adjusting member relative to the main frame and said at least one corresponding sliding member in a corresponding one of said opposite directions, and wherein the control device controls the driving device to move the carriage in one of said opposite directions such that one of the two engageable portions of the first gap adjusting portion and one of the two engageable portions of the second gap adjusting portion engage one of the opposite ends of the adjusting member of the first gap adjusting portion and one of the opposite ends of the adjusting member of the second gap adjusting portion, respectively, move the two adjusting members as the respective adjusting members of the first and second gap adjusting portions, relative to the main frame and said at least two sliding members in an other of said opposite directions, and thereby increase the respective distances between the main frame and the respective sliding surfaces of said at least two sliding members in the perpendicular direction, and to move the carriage in said other direction such that an other of the two engageable portions of the first gap adjusting portion and an other of the two engageable portions of the second gap adjusting portion engage an other of the opposite ends of the adjusting member of the first gap adjusting portion and an other of the opposite ends of the adjusting member of the second gap adjusting portion, respectively, move the two adjusting members relative to the main frame and said at least two sliding members in said one direction, and thereby decrease the respective distances between the main frame and the respective sliding surfaces of said at least two sliding members in the perpendicular direction.

2. The image recording apparatus according to claim 1, wherein the two guide frames are distant from each other, in the conveying direction, by a first distance greater than a second distance between the two guide frames in the perpendicular direction.

3. The image recording apparatus according to claim 1, wherein the image recording head comprises an ink-jet recording head which ejects a droplet of ink and thereby records the image on the recording medium.

4. The image recording apparatus according to claim 1, wherein the carriage includes at least three said sliding members comprising:

at least two first sliding members which are distant from each other in the parallel direction and which slide on one of the two guide frames in said each of said opposite directions; and at least one second sliding member which slides on an other of the two guide frames in said each of said opposite directions.

5. The image recording apparatus according to claim 1, further comprising a platen which extends parallel to the two guide frames and is opposed to the image recording head in the perpendicular direction and which supports the recording medium, wherein the gap adjusting device adjusts a gap between the platen and the image recording head in the perpendicular direction and thereby adjusts the gap between the recording medium and the image recording head in the perpendicular direction.

6. The image recording apparatus according to claim 1, wherein each of the two adjusting members has, in the parallel direction, a dimension greater than a dimension of the main frame in the parallel direction, such that each of the opposite ends of said each adjusting member is projectable out of the main frame in a corresponding one of said opposite directions, and wherein the two engageable portions of said each of the first gap adjusting portion and the second gap adjusting portion are distant from each other in the parallel direction.

7. The image recording apparatus according to claim 1, wherein the control device controls the driving device to move the carriage in said one of said opposite directions such that said one of the two engageable portions of the first gap adjusting portion and said one of the two engageable portions of the second gap adjusting portion concurrently engage said one of the opposite ends of the adjusting member of the first gap adjusting portion and said one of the opposite ends of the adjusting member of the second gap adjusting portion, respectively, concurrently move the two adjusting members relative to the main frame and said at least two sliding members in said other of said opposite directions, and thereby concurrently increase the respective distances between the main frame and the respective sliding surfaces of said at least two sliding members in the perpendicular direction, so as to translate the main frame relative to the two guide frames in the perpendicular direction, and to move the carriage in said other direction such that said other of the two engageable portions of the first gap adjusting portion and said other of the two engageable portions of the second gap adjusting portion concurrently engage said other of the opposite ends of the adjusting member of the first gap adjusting portion and said other of the opposite ends of the adjusting member of the second gap adjusting portion, respectively, concurrently move the two adjusting members relative to the main frame and said at least two sliding members in said one direction, and thereby concurrently decrease the respective distances between the main frame and the respective sliding surfaces of said at least two sliding members in the perpendicular direction, so as to translate the main frame relative to the two guide frames in the perpendicular direction.

8. The image recording apparatus according to claim 1, wherein each of the two adjusting members has, in the parallel direction, a plurality of stepped portions which have respective different dimensions in the perpendicular direction and each one of which is insertable between the main frame and one of said at least two sliding members that corresponds to said each adjusting member.

9. The image recording apparatus according to claim 8, wherein said each of said at least two sliding members includes:

a contact plate which has, as one of opposite surfaces thereof, the sliding surface which slides on said corresponding one of the two guide frames; and at least one leg portion which extends from an other of the opposite surfaces of the contact plate in the perpendicular direction, wherein one of (a) said at least two sliding members and (b) the main frame has at least two guide grooves extending in the perpendicular direction, wherein an other of (a) said at least two sliding members and (b) the main frame has at least two fitting portions each of which fits in a corresponding one of said at least two guide grooves such that said each fitting portion is movable by being guided by said corresponding guide groove in the perpendicular direction, and wherein said each of the two adjusting members has at least one elongate hole which is formed through the respective different dimensions of the stepped portions thereof and through which said at least one leg portion of said at least one corresponding sliding member extends such that said each adjusting member is movable relative to the main frame and said at least one corresponding sliding member in said each of said opposite directions so that said at least one leg portion is aligned with an arbitrary one of the stepped portions.

10. The image recording apparatus according to claim 9, wherein said at least two sliding members have said at least two guide grooves, respectively, and the main frame has said at least two fitting portions.

11. The image recording apparatus according to claim 9, further comprising two positioning devices each of which positions a corresponding one of the two adjusting members relative to the main frame in the conveying direction, wherein said each fitting portion and said corresponding guide groove have a substantially same dimension in the parallel direction, such that in a state in which said each fitting portion fits in said corresponding guide groove, a corresponding one of said at least two sliding members is positioned relative to the main frame in the parallel direction, wherein the elongate hole of said each adjusting member and said at least one leg portion of said at least one corresponding sliding member have a substantially same dimension in the conveying direction, such that in a state in which said at least one leg portion of said at least one corresponding sliding member extends through the elongate hole of said each adjusting member, said at least one corresponding sliding member is positioned relative to said each adjusting member, and is positioned relative to the main frame via said each adjusting member, in the conveying direction, and wherein in a state in which the other surface of the contact plate of said each sliding member contacts an arbitrary one of the stepped portions of a corresponding one of the two adjusting members, the contact plate is positioned parallel to a surface of a corresponding one of the two guide frames, and is positioned relative to the main frame via the arbitrary stepped portion of said corresponding adjusting member in the perpendicular direction.

12. The image recording apparatus according to claim 1, wherein the first and second gap adjusting portions further include at least two biasing members each of which is provided between the main frame and a corresponding one of said at least two sliding members and which biases the main frame toward a corresponding one of the two guide frames in the perpendicular direction.

13. The image recording apparatus according to claim 12, wherein said each of said at least two biasing members applies a biasing force to said corresponding sliding member, such that said corresponding sliding member closely contacts a corresponding one of the two adjusting members, and wherein at least one of (a) the biasing force of said each biasing member and (b) a portion of a self weight of the carriage which portion is applied to said corresponding adjusting member is so selected as to assure that, when the carriage is reciprocated, said corresponding adjusting member is prevented from being moved by an inertia thereof relative to said corresponding sliding member and the main frame in said each of said opposite directions, owing to a frictional force produced between (c) each of said corresponding sliding member and the main frame, and (d) said corresponding adjusting member.

14. The image recording apparatus according to claim 12, wherein the main frame has at least two first biasing-member holding portions, and wherein said each of said at least two sliding members includes at least one second biasing-member holding portion which cooperates with a corresponding one of said at least two first biasing-member holding portions to hold a corresponding one of said at least two biasing members, such that said corresponding biasing member biases the main frame toward a corresponding one of the two guide frames.

15. The image recording apparatus according to claim 1, wherein the first gap adjusting portion and the second gap adjusting portion cooperate with each other to translate, by utilizing said portion of the reciprocating movement of the carriage, the main frame relative to the two guide frames and thereby adjust, in the perpendicular direction, the gap between the recording medium and the image recording head.

16. The image recording apparatus according to claim 15, wherein the first gap adjusting portion and the second gap adjusting portion cooperate with each other to translate the main frame relative to the two guide frames in a vertical direction while the main frame maintains a horizontal posture.

* * * * *